US005579637A

United States Patent [19]

Yamashita et al.

[11] Patent Number: 5,579,637

[45] Date of Patent: Dec. 3, 1996

[54] AIR-FUEL RATIO CONTROL APPARATUS FOR ENGINE

[75] Inventors: Yukihiro Yamashita; Jun Hasegawa, both of Kariya-city, Japan

[73] Assignee: Nippondenso Co., Ltd., Kariya, Japan

[21] Appl. No.: 451,662

[22] Filed: May 26, 1995

[30] Foreign Application Priority Data

May 31, 1994 [JP] Japan ..... 6-119006
Feb. 1, 1995 [JP] Japan ..... 7-015309

[51] Int. Cl.[6] ..... F01N 3/28

[52] U.S. Cl. ..... 60/276; 60/277; 60/285

[58] Field of Search ..... 60/276, 277, 285

[56] References Cited

U.S. PATENT DOCUMENTS 4,693,076 9/1987 Chujo et al. .
5,359,852 11/1994 Curran ..... 60/276
5,491,975 2/1996 Yamashita .

FOREIGN PATENT DOCUMENTS 61-237852 10/1986 Japan .
61-265336 11/1986 Japan .
63-111252 5/1988 Japan .
1110853 4/1989 Japan .
2238147 9/1990 Japan .
3185244 8/1991 Japan .

*Primary Examiner*—Douglas Hart
*Attorney, Agent, or Firm*—Cushman, Darby and Cushman IP Group of Pillsbury Madison & Sutro LLP

[57] ABSTRACT

An air-fuel ratio control apparatus for an engine for reliably converging an air-fuel ratio around a stoichiometric air-fuel ratio to prevent harmful exhaust components from being discharged into the air is described. The apparatus includes a CPU which determines an inversion direction of an output of an $O_2$ sensor on the downstream side of a catalytic converter, corrects a target air-fuel ratio λTG in a step-like fashion in the opposite direction by a skip amount and calculates a fuel injection amount every injection timing on the basis of a difference between the corrected target air-fuel ratio λTG and an air-fuel ratio λ detected by an $O_2$ sensor on the upstream side of the exhaust flow. The target air-fuel ratio is reflected immediately in the fuel injection amount at an updating rate of every ilnjection timing, so that the fuel injection amount may be controlled with an excellent responsiveness to turbulence in the air-fuel ratio. Further, upper and lower limit guard values λTGL and λTGR for the target air-fuel ratio λTG are set based on a mass of absorbed substances in the catalytic converter after learning variations in the operating parameters of the downstream side $O_2$ sensor and the like, so that large turbulence of the air-fuel ratio on the downstream side of the catalytic converter is suppressed and the air-fuel ratio may be reliably controlled around a stoichiometric air-fuel ratio.

11 Claims, 20 Drawing Sheets

EXCEEDING GUARD VALUE
R
0.45V
(λ=1)
L
OUTPUT OF
DOWNSTREAM
O2 SENSOR
(VOX2)

λ TGL
λ TGW
λ TGC
λ TGR
EXCEEDING GUARD VALUE
λ SKR
λ SKL
COMPLETION
OF LEARNING
L
λ=1
R
TARGET A/F RATIO
(λ TG)

DISTURBANCE
L
R
ACTUAL A/F RATIO
(λ)

TIME (msec)

AIR-FUEL RATIO CONTROL APPARATUS FOR ENGINE

CROSS-REFERENCE TO RELATED APPLICATIONS

This application is related to and claims priority under 35 U.S.C. § 119 from Japanese Patent Application Nos. Hei. 6-119006 and Hei. 7-15309, which are incorporated herein by reference.

BACKGROUND OF THE INVENTION

1. Field of the Invention

The present invention relates to an air-fuel ratio control apparatus for an engine and more particularly to an air-fuel ratio control apparatus for an engine comprising sensors, provided respectively on the upstream and downstream sides of a catalytic converter, for detecting an air-fuel ratio of exhaust gas passing through the catalytic converter to implement air-fuel ratio feedback control on the basis of the air-fuel ratio detected by the downstream sensor, in addition to air-fuel ratio feedback control on the basis of the air-fuel ratio detected by the upstream sensor.

2. Description of the Related Art

Japanese Patent Application Laid-Open No. 61-232350 discloses an air-fuel ratio controller which guards against deviation from a centered control value when an oxygen ($O_2$) sensor for detecting $O_2$ concentration in exhaust gas on the upstream side of a three-component catalytic converter deteriorates.

Also, the air-fuel ratio controller disclosed in Japanese Patent Application Laid-Open No. 2-238147 controls an air-fuel ratio correction coefficient FAF based on an output voltage VOX2 of an $O_2$ sensor on the downstream side of a catalytic converter as shown in FIG. 19. Using this system, the actual air-fuel ratio converges on a stoichiometric air-fuel ratio using $O_2$ sensors respectively on the upstream side and downstream side of the catalytic converter to determine whether the exhaust gas is rich or lean based on the output voltage of the $O_2$ sensor on the upstream side. This is done by driving the air-fuel ratio correction coefficient FAF in the opposite fluctuation direction as the air-fuel ratio using predetermined constants of integration KIR and KIL, and by driving the air-fuel ratio correction coefficient FAF to the opposite side of the fluctuation direction of the air-fuel ratio through a skip discontinuity by skip amounts RRS and RSL. Further, when the output voltage VOX2 of the $O_2$ sensor on the downstream side is richer than a predetermined threshold value VRL or leaner than a predetermined threshold value VLL, the skip amounts RSR and RSL described above are increased to effect a large change in the air-fuel ratio correction coefficient FAF in order to complete the correction of the air-fuel ratio quickly.

Furthermore, using the system disclosed in Japanese Patent Application Laid-Open No. 3-185244, the actual air-fuel ratio converges on a stoichiometric air-fuel ratio by providing $O_2$ sensors respectively on the upstream side and downstream side of the catalytic converter to determine whether the air-fuel ratio is rich or lean based on the output voltage VOX2 of the $O_2$ sensor on the downstream side of the catalytic converter and by driving the target air-fuel ratio in the opposite fluctuation direction at a constant speed using a predetermined rich integration amount IR and a predetermined lean integration amount IL, as shown in FIG. 20.

Then, a correction coefficient FAF is calculated at a predetermined updating speed based on a difference between the target air-fuel ratio after the correction and the actual air-fuel ratio detected by the $O_2$ sensor on the upstream side of the catalytic converter.

The use of a sub-feedback (F/B) system employing guard values has been proposed. In such a system, the guard values prohibit excessive deviation from a central control value when the $O_2$ sensor on the upstream side deteriorates.

Further, because the skip amounts RSR and RSL based on an output voltage VOX1 of the $O_2$ sensor on the upstream side are increased and decreased based on the output voltage VOX2 of the $O_2$ sensor on the downstream side as shown in FIG. 19, the correction amount effected by the $O_2$ sensor on the downstream side is reflected in the air-fuel ratio correction coefficient FAF only when the air-fuel ratio detected by the $O_2$ sensor on the upstream side crosses the stoichiometric air-fuel ratio and the skip amounts RSR and RSL are used. Accordingly, even if the $O_2$ sensor on the downstream side detects that the air-fuel ratio has exceeded the rich side allowable value VAL at time t1, the air-fuel ratio correction coefficient FAF is corrected by the skip amount RSL which has increased based on the value detected at a considerably delayed time t2. Then, due to an overcorrection caused by the delay, the air-fuel ratio fluctuates periodically between the rich side and the lean side without converging on the stoichiometric air-fuel ratio and thereby CO, HC and NOx alternately appear in the exhaust gas.

Furthermore, because the air-fuel ratio correction coefficient FAF is calculated at a predetermined updating rate based on the difference between the target air-fuel ratio after correction by the output voltage VOX2 of the $O_2$ sensor on the downstream side and an actual air-fuel ratio as indicated by the output voltage VOX1 detected by the $O_2$ sensor on the upstream side as shown in FIG. 20, the rich integration amount IR and lean integration amount IL are immediately reflected in the air-fuel ratio correction coefficient FAF. However, since the engine, including the catalytic converter, is a system originally having a large delay, the air-fuel ratio on the upstream side is already largely disturbed in either direction from the stoichiometric air-fuel ratio at the point in time when the fluctuation direction of the air-fuel ratio of the exhaust gas has been inverted between rich and lean, and at that point it is difficult to suppress the turbulence of the air-fuel ratio caused on the downstream side thereafter by the delicate correction by means of the rich integration amount IR or lean integration amount IL. Accordingly, there has been a problem similar to the case described above, where the air-fuel ratio is overcorrected due to the delay in correction and does not converge to the stoichiometric air-fuel ratio, and that CO, HC or NOx are discharged from the engine.

SUMMARY OF THE INVENTION

Accordingly, it is an object of the present invention to solve the aforementioned problems by providing an air-fuel ratio control apparatus for an engine which can avoid delays in the correction process on the basis of the air-fuel ratio on the downstream side of the catalytic converter, reliably converge the air-fuel ratio around the stoichiometric air-fuel ratio and prevent harmful components from being released into the air.

To achieve these and other objectives, a first aspect of the present invention provides an inversion direction determining section which determines an inversion direction of an air-fuel ratio on the downstream side of a catalytic converter when it is inverted and passes through a stoichiometric air-fuel ratio, a target air-fuel ratio setting section which corrects a target air-fuel ratio by a skip amount to the opposite side of the inversion direction, and an injection amount calculating section which calculates an injection amount of a fuel injection valve at a predetermined updating speed based on a difference between the air-fuel ratio detected by the upstream side air-fuel ratio detecting device and the target air-fuel ratio set by the target air-fuel ratio setting section. Because the injection amount calculating section thus calculates the fuel injection amount at the predetermined updating rate, the target air-fuel ratio set by the target air-fuel ratio setting section is reflected immediately in the fuel injection amount and the injection amount can be controlled with excellent responsiveness to turbulence in the air-fuel ratio. When the air-fuel ratio detected by the downstream side air-fuel ratio detecting device is inverted, the target air-fuel ratio is corrected in a step-like fashion by the skip amount, so that large turbulence in the air-fuel ratio on the downstream side of the catalytic converter thereafter may be reliably controlled. Further, variations in the operating characteristics of the upstream side air-fuel ratio detecting device, the downstream side air-fuel ratio detecting device, the catalytic converter and the engine are learned by a learning section and after finishing the learning by the learning section, upper and lower limit guard values are set by target air-fuel ratio guard setting section, so that the target air-fuel ratio may be set near a stoichiometric air-fuel ratio, and the air-fuel ratio can be prevented from deviating and shifting from the stoichiometric air-fuel ratio by a large amount.

In a second embodiment of the present invention, a catalyst deterioration detecting section detects a deterioration state of the catalyst and based on that result, the guard width of the upper and lower limit guards is increased or decreased. That is, the newer the catalytic converter, the wider the guard width, because it has more purging ability.

In a third embodiment of the present invention, a target air-fuel ratio setting section forcibly returns the target air-fuel ratio to the learned value if the target air-fuel ratio has not returned to the learned value within a predetermined time after reaching either the upper or lower limit guards, so that a long-term overcorrection by which the air-fuel ratio deviates from the stoichiometric air-fuel ratio is prevented.

In this embodiment, the predetermined time may be set at varying lengths depending on the degree of deterioration of the catalyst based on the size of the catalytic converter.

In a fourth embodiment of the present invention, a relearning setting section causes learning to be done again if the value from the downstream side air-fuel ratio detecting device has not returned to a predetermined value within a predetermined time, so that the reliability of the learned value is increased, thus allowing an accurate control.

According to a fifth embodiment of the present invention, an inversion direction determining section determines an inversion direction of an air-fuel ratio on the downstream side of a catalytic converter detected by a downstream side air-fuel ratio detecting device when it is inverted and shifted passing through a stoichiometric air-fuel ratio, a target air-fuel ratio setting section corrects a target air-fuel ratio by a skip amount to the opposite,side of the inversion direction, and an injection amount calculating section calculates an injection amount of a fuel injection valve at a predetermined updating speed based on a difference between the air-fuel ratio detected by the upstream side air-fuel ratio detecting section and the target air-fuel ratio set by the target air-fuel ratio setting section. Because the injection amount calculating section thus calculates the fuel injection amount at the predetermined updating speed, the target air-fuel ratio set by the target air-fuel ratio setting section is reflected immediately in the fuel injection amount, and the injection amount can be controlled with excellent responsiveness to turbulence in the air-fuel ratio. When the air-fuel ratio detected by the downstream side air-fuel ratio detecting device is inverted, the target air-fuel ratio is corrected in a step-like fashion by the skip amount, so that large turbulence in the air-fuel ratio on the downstream side of the catalytic converter thereafter may be reliably controlled. Further, variations in the operating characteristics of the upstream side air-fuel ratio detecting device, the downstream side air-fuel ratio detecting device, the catalytic converter and the engine are learned by a learning section and after finishing the learning by the learning section, a guard width of the upper and lower limit guards set in advance by target air-fuel ratio guard setting section is narrowed. That is, the guard width of the upper and lower limit guards may be set near the stoichiometric air-fuel ratio with an adequate timing and width by narrowing it after the target air-fuel ratio is converged to a certain degree, thus preventing the air-fuel ratio from deviating and shifting from the stoichiometric air-fuel ratio by a large amount.

In this embodiment, the guard width whose upper and lower guards have been narrowed by the target air-fuel ratio guard setting section is set at between 0.2 to 1.0% of the target air-fuel ratio $\lambda TG$. By adequately narrowing the control range of the upper and lower limit guards for the target air-fuel ratio against the deterioration and dispersion of the catalytic converter, overcorrection which causes the target air-fuel ratio to deviate from the stoichiometric air-fuel ratio is prevented.

BRIEF DESCRIPTION OF THE DRAWINGS

Other objects, features and characteristics of the present invention as well as the functions of related parts will become more clear from a study of the following detailed description, the appended claims, and the drawings. In the accompanying drawings:

DETAILED DESCRIPTION OF THE PRESENTLY PREFERRED EXEMPLARY EMBODIMENTS

Figure 1:
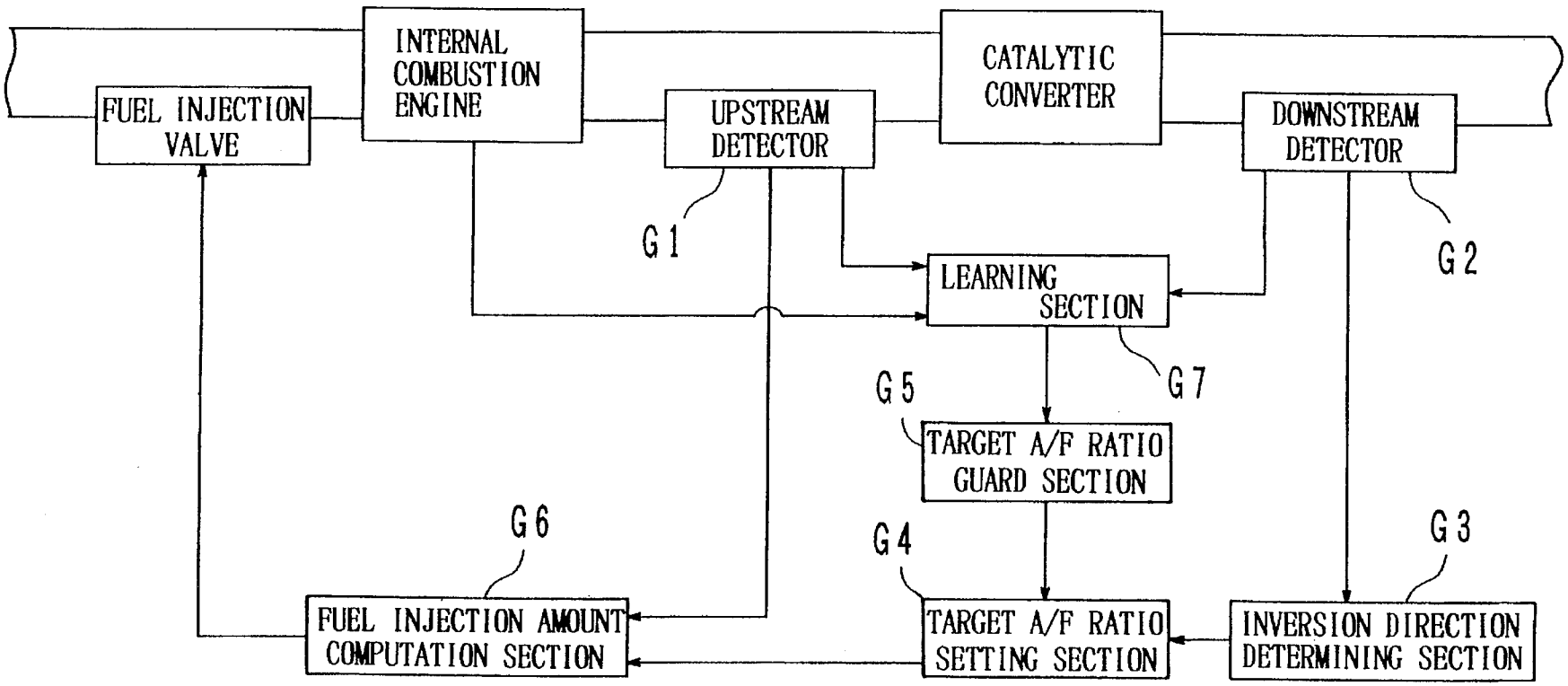
FIG. 1 is a block diagram showing an air-fuel ratio control apparatus for an engine according to a first embodiment of the present invention.

The air-fuel ratio control system of the internal combustion engine, as shown in FIG. 1, is furnished with the following: an upstream side air-fuel ratio detector G1 that detects the air-fuel ratio of the exhaust gas, at the upstream side, from the internal combustion engine, and which is placed at the upstream side of the catalytic converter of the internal combustion engine's exhaust route; a downstream side air-fuel ratio detector G2 that detects the air-fuel ratio, at the downstream side, of the exhaust gas that has passed through the catalytic converter, and which is placed at the downstream side of the catalytic converter; a reverse direction determining section G3 that detects a reversal in the direction of an air-fuel ratio variation, and checks if the ratio is lean or rich by checking if it has passed through a stoichiometric air-fuel ratio; a target air-fuel ratio setting section G4 that sets the target air-fuel ratio and which compensates the air-fuel ratio at predetermined skip amounts in the direction opposite that of the direction detected by the reverse direction determining section; a target air-fuel ratio guard section G5 that sets the upper and lower guards values of the intended air-fuel ratio compensated in section G4 based on the amount of the adsorbent in the catalytic converter; a fuel injection amount computation section G6 that computes the amount of fuel to be injected at designated intervals based on the difference of the air-fuel ratio detected in G1 and the intended ratio that was set in section G4; and a learning section G7 that sets the upper and lower limit guards of section G5 after learning the variance in the conditions of any one of the following: section G1, section G2, the catalytic converter and the internal combustion engine.

Figure 2:
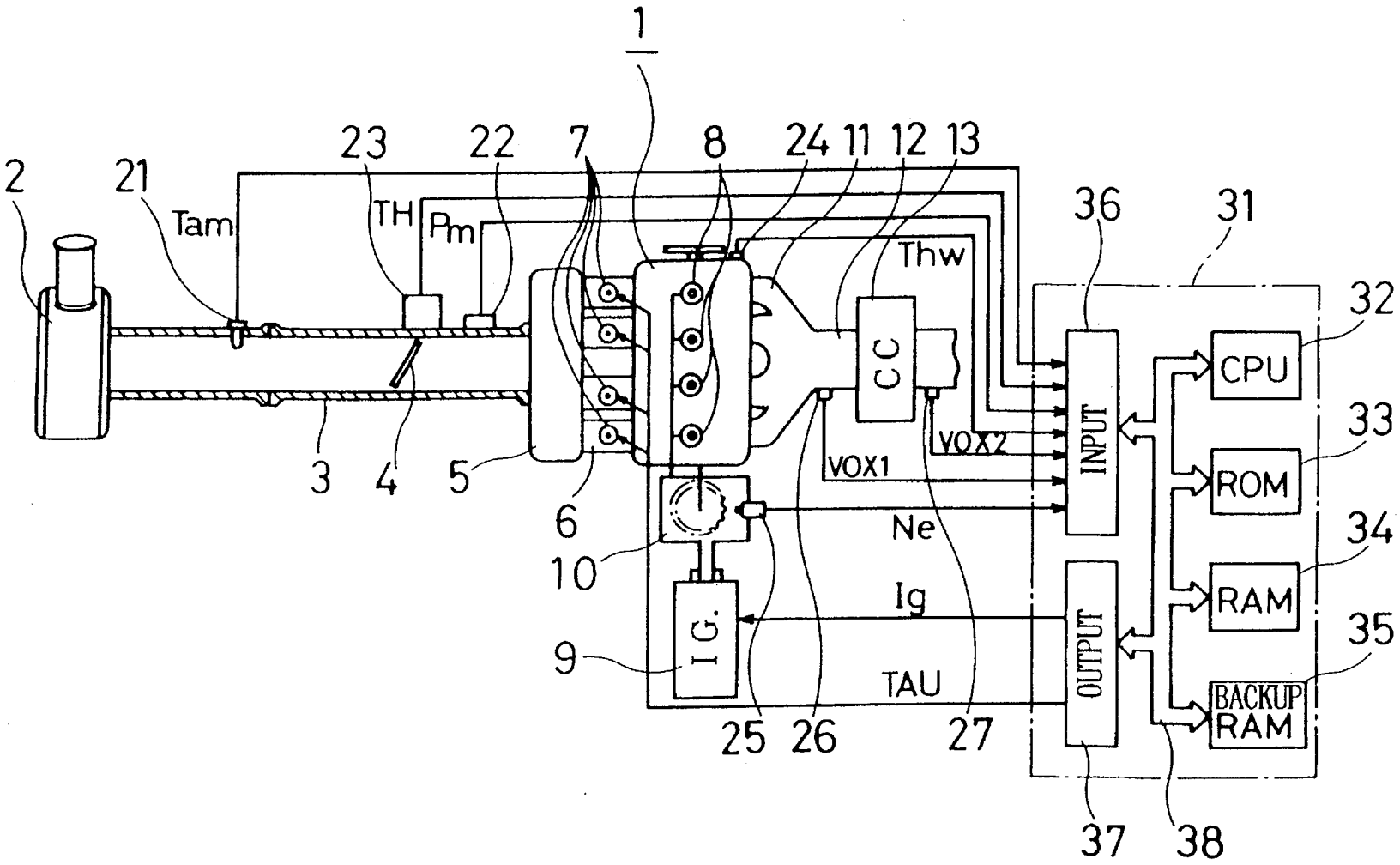
FIG. 2 is a structural diagram of an engine and peripheral devices thereof according to the first embodiment of the present invention.

FIG. 2 is a schematic structural view of an engine and peripheral devices thereof using an air-fuel ratio control apparatus for an engine according to a first embodiment of the present invention.

In FIG. 2, engine 1 is typically a spark ignition type engine having four cylinders and four cycles. Intake air enters the engine from the upstream side through an air cleaner 2, an intake pipe 3, a throttle valve 4, a surge tank 5 and an intake manifold 6, is mixed with fuel injected from fuel injection valves 7 within the intake manifold 6 and is distributed and fed to each cylinder as a mixture gas having a predetermined air-fuel ratio. A high voltage supplied from an ignition circuit 9 is distributed and supplied to a spark plug 8 provided for each cylinder in the engine 1 to ignite the mixture gas in each cylinder at a predetermined timing in accordance with distributor 10. Exhaust gas produced by combustion of the mixture gas is discharged into the air through an exhaust manifold 11 and an exhaust pipe 12 after purifying harmful components (CO, HC, NOx, and the like) using a three-component catalytic converter 13 provided within the exhaust pipe 12.

The intake pipe 3 has an intake temperature sensor 21 for detecting a temperature Tam of the intake air and an intake pressure sensor 22 for detecting an intake pressure Pm on the downstream side of the throttle valve 4. The throttle valve 4 is provided with a throttle sensor 23 for detecting a throttle opening degree TH. The throttle sensor 23 outputs not only an analog signal corresponding to the throttle opening degree TH but also an on/off signal from an idle switch (not shown) signifying that the throttle valve 4 is almost fully closed. A warm-up sensor 24 for detecting a temperature Thw of cooling water in the engine 1 is provided in the cylinder block of the engine 1. A rotational speed sensor 25 for detecting a rotational speed Ne of the engine is provided in the distributor 10. This rotational speed sensor 25 outputs 24 pulse signals every other rotation, i.e. 720° CA (crank angle), of the engine 1. Further, an $O_2$ sensor 26 for outputting a linear air-fuel ratio signal VOX1 corresponding to an air-fuel ratio $\lambda$ of the exhaust gas discharged from the engine 1 is provided on the upstream side of the catalytic converter 13 in the exhaust pipe 12 and an $O_2$ sensor 27 for outputting a voltage VOX2 indicating whether the air-fuel ratio $\lambda$ of the exhaust gas is rich or lean (relative to a stoichiometric air-fuel ratio $\lambda=1$) is on the downstream side of the catalytic converter 13.

An electronic control unit (ECU) 31 for controlling the engine 1 includes a CPU, 32, ROM 33, RAM 34 and backup RAM 35. It is connected to an input port 36 for inputting detection signals from each sensor, an output port 37 for outputting control signals to each actuator, and the like through a bus 38. The ECU 31 receives the signals indicative of the intake temperature Tam, intake pressure PM, throttle opening degree TH, cooling water temperature Thw, rotational speed Ne, air-fuel ratio signal VOX1, output voltage VOX2, and the like from each sensor through the input port 36. It then calculates a fuel injection amount TAU and an ignition timing Ig based on those signals and outputs control signals to the fuel injection valves 7 and the ignition circuit 9.

The air-fuel ratio control related to the fuel injection amount TAU will be explained hereinbelow.

The ECU 31 has been previously designed by the following method in order to execute air-fuel ratio control. The designing method, which will be explained hereinbelow, is disclosed in Japanese Patent application Laid-Open No. 64-110853 which is hereby incorporated by reference.

(1) Modeling of object to be controlled:

In the present embodiment, as a model of a system for controlling the air-fuel ratio λ of the engine 1, an autoregressive moving average model of degree 1 having a dead time P=3 is used and is approximated further in consideration of a disturbance d.

First, the model of the system for controlling the air-fuel ratio λ using the autoregressive moving average model can be approximated as follows:

$$\lambda(k)=a*\lambda(k-1)+b*FAF(k-3) \tag{1}$$

where λ is an actual air-fuel ratio, FAF is the air-fuel ratio correction coefficient, a and b are constants, and k is a variable indicating a number of control times from the start of the first sampling. Further, when the disturbance d is considered, the model of the control system may be approximated as follows:

$$\lambda(k)=a*\lambda(k-1)+b*FAF(k-3)+d(k-1) \tag{2}$$

For the models which were approximated as described above, it is easy to obtain the constants a and b discretely by the rotational synchronous (360° CA) sampling using a step response, i.e. to obtain a transfer function G of the system for controlling the air-fuel ratio λ.

(2) Method for representing state variable amount X:

By rewriting the above equation (2) by using the state variable amount X (k)=[X1 (k), X2 (k), X3 (k), X4 (k)]$^T$, the following equation is obtained.

$$\begin{bmatrix} X1(k+1) \\ X2(k+1) \\ X3(k+1) \\ X4(k+1) \end{bmatrix} = \begin{bmatrix} a & b & 0 & 0 \\ 0 & 0 & 1 & 0 \\ 0 & 0 & 0 & 1 \\ 0 & 0 & 0 & 0 \end{bmatrix} \begin{bmatrix} X1(k) \\ X2(k) \\ X3(k) \\ X4(k) \end{bmatrix} + \begin{bmatrix} 0 \\ 0 \\ 0 \\ 1 \end{bmatrix} FAF(k) + \begin{bmatrix} 1 \\ 0 \\ 0 \\ 0 \end{bmatrix} d(k) \tag{3}$$

Then, we have $$X1\ (k+1)=aX1\ (k)+bX2(k)+d(k)=\lambda(k+1)$$

$$X2\ (k+1)=FAF(k-2)$$

$$X3\ (k+1)=FAF(k-1)$$

$$X4\ (k+1)=FAF(k) \tag{4}$$

(3) Designing of regulator:

A regulator is designed using an optimum feedback gain K=[K1, K2, K3, K4] and the state variable amount $X^T$(k)=[λ(k), FAF(k−3), FAF(k−2), FAF (k−1)], so that $$\begin{aligned} FAF(k) &= K * X^T(k) \\ &= K1 * \lambda(k) + K2 * FAF(k-3) + \\ &\quad K3 * FAF(k-2) + K4 * FAF(k-1) \end{aligned} \tag{5}$$

is obtained. Further, an integration term Z1 (k) for absorbing errors is added.

$$FAF(k)=K1*\lambda(k)+K2*\ FAF(k-3)+K3*\ FAF(k-2)+K4*FAF(k-1)+Z1(k) \tag{6}$$

Thereby, the air-fuel ratio λ and the correction coefficient FAF can be obtained.

The integration term Z1 (k) is a value which is determined by the deviation of an actual air-fuel ratio λ(k) from a target air-fuel ratio λTG and by an integration constant Ka, and is obtained from the following equation:

$$Z1(k)=Z1(k-1)+Ka*(\lambda TG-\lambda(k)) \tag{7}$$

Figure 3:
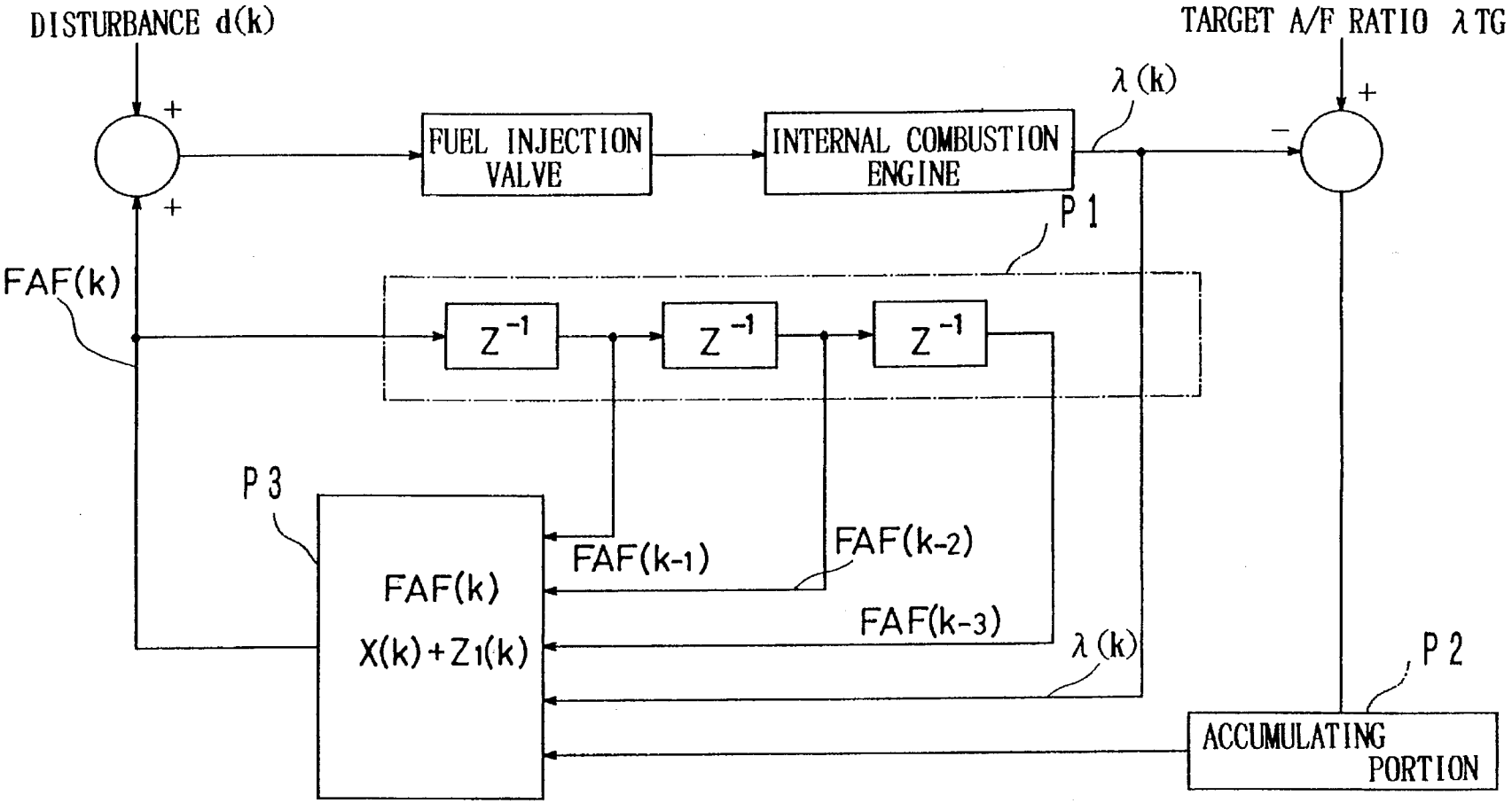
FIG. 3 is a block diagram showing the principle of operation of the first embodiment of the present invention.

FIG. 3 is a block diagram of a system for controlling the air-fuel ratio λ by which the model was designed as described above. While FIG. 3 is shown using the Z−1 transformation to derive the air-fuel ratio correction coefficient FAF(k) from FAF(k−1), the past air-fuel ratio correction coefficient FAF(k−1) is stored in the RAM 34 and is read out and used at the next control timing. The block P1 surrounded by the dotted line in FIG. 3 corresponds to a portion of the system which determines the state variable amount X(k) in a State in which the air-fuel ratio λ(k) is feedback controlled to the target air-fuel ratio λTG. The block P2 corresponds to a portion of the system (an accumulating portion) for obtaining the integration term Z1 (k). The block P3 corresponds to a portion of the system for calculating the present air-fuel ratio correction coefficient FAF(k) from the state variable amount X (k) which was determined in the block P1 and the integration term Z1 (k) which was obtained in the block P2.

(4) Determination of optimum feedback gain K and integration constant Ka:

The optimum feedback gain K and the integration constant Ka can be set by minimizing an evaluation function J which is represented by the following equation, for example:

$$J=\sum_{k=0}^{\infty}\{Q\ (\lambda(k)-\lambda TG)^2+R(FAF(k)-FAF(k-1)^2\} \tag{8}$$

The evaluation function J is intended to minimize the deviation between the actual air-fuel ratio λ(k) and the target air-fuel ratio λTG while restricting the motion of the air-fuel ratio correction coefficient FAF(k). A weighting of the restriction of the air-fuel ratio correction coefficient FAF (k) can be changed by values of weight parameters Q and R. Therefore, optimal control characteristics may be obtained by repeating simulations by variably changing the values of the weight parameters Q and R to determine the optimum feedback gain K and the integration constant Ka.

Further, the optimum feedback gain Ka and the integration constant Ka depend on the model constants a and b. Therefore, in order to assure the stability (robust performance) of the system in the event of a fluctuation (parameter fluctuation) of the system for controlling the actual air-fuel ratio λ, it is necessary to design the optimum feedback gain K and the integration constant Ka in consideration of fluctuation amounts of the model constants a and b. Accordingly, the simulations are executed in consideration of the fluctuations of the model constants a and b which can be actually caused, thereby determining the optimum feedback gain K and the integration constant Ka which satisfy the stability.

While (1) modeling of object to be controlled, (2) method for representing state variable amount, (3) designing of regulator, and (4) determination of optimum feedback gain and integration constant have been described above, they are predetermined and the ECU 31 executes the control by using the result thereof, i.e., only the equations (6) and (7).

The operation of the air-fuel ratio control apparatus of the present embodiment constructed as described above will now be explained.

Figure 4:
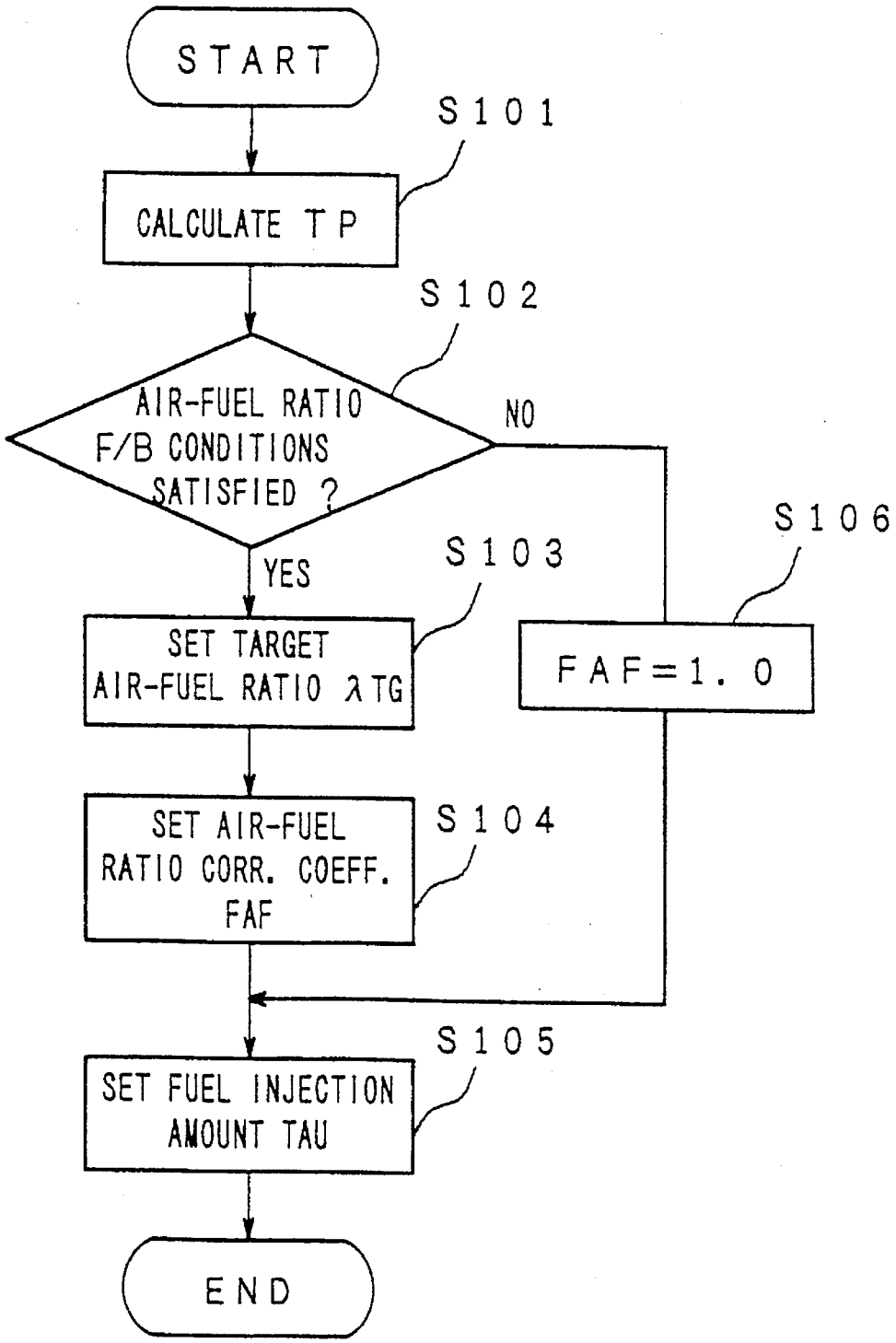
FIG. 4 is a flowchart showing a routine for calculating a fuel injection amount according to the first embodiment of the present invention.

FIG. 4 is a flowchart showing a routine for calculating a fuel injection amount according to the first embodiment of the present invention.

First, Step 101 calculates a fundamental fuel injection amount TP on the basis of the intake pressure Pm, rotational speed Ne, and the like. Step 102 determines whether the feedback conditions of the air-fuel ratio λ are satisfied or not. The feedback conditions are satisfied when the cooling water temperature Thw is equal or higher than a predetermined value and a load and a rotational speed are not high, as is well known.

When the feedback conditions of the air-fuel ratio λ are satisfied in Step 102, the target air-fuel ratio λTG is set in Step 103 (which will be explained in greater detail later). Next, in Step 104, the air-fuel ratio correction coefficient FAF is set so that the air-fuel ratio λ becomes equal to the target air-fuel ratio λTG. That is, the air-fuel ratio correction coefficient FAF is calculated by Equations (6) and (7) in accordance with the target air-fuel ratio λTG and the air-fuel ratio λ(k) detected by the upstream side sensor 26. On the other hand, when the feedback conditions of the air-fuel ratio λ are not satisfied in Step 102, the air-fuel ratio correction coefficient FAF is set at 1.0 in Step 106. Then, Step 105 follows.

In Step 105, the fuel injection amount TAU is set from the fundamental fuel injection amount TP, air-fuel ratio correction coefficient FAF and other correction coefficient FALL by the following equation.

$$TAU=TP\times FAF\times FALL$$

A control signal which is based on the fuel injection amount TAU set as described above is output to the fuel injection valves 7 to control a fuel injection valve opening time, i.e., an actual fuel injection amount. As a result, the mixture gas is adjusted to the target air-fuel ratio λTG.

Figure 5:
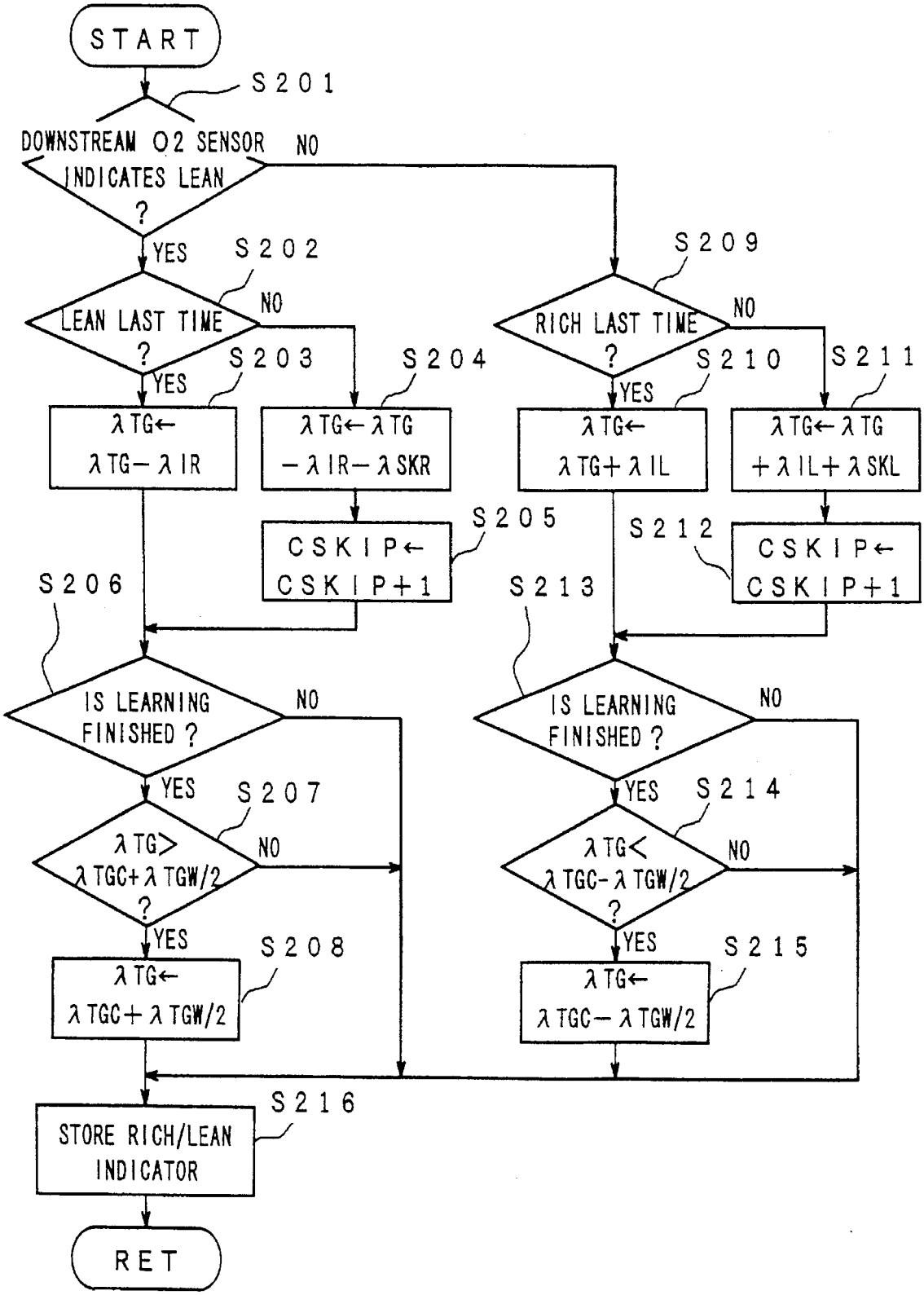
FIG. 5 is a flowchart showing a routine for controlling inversion skips according to the first embodiment of the present invention.
Figures 6A, 6B, 6C:
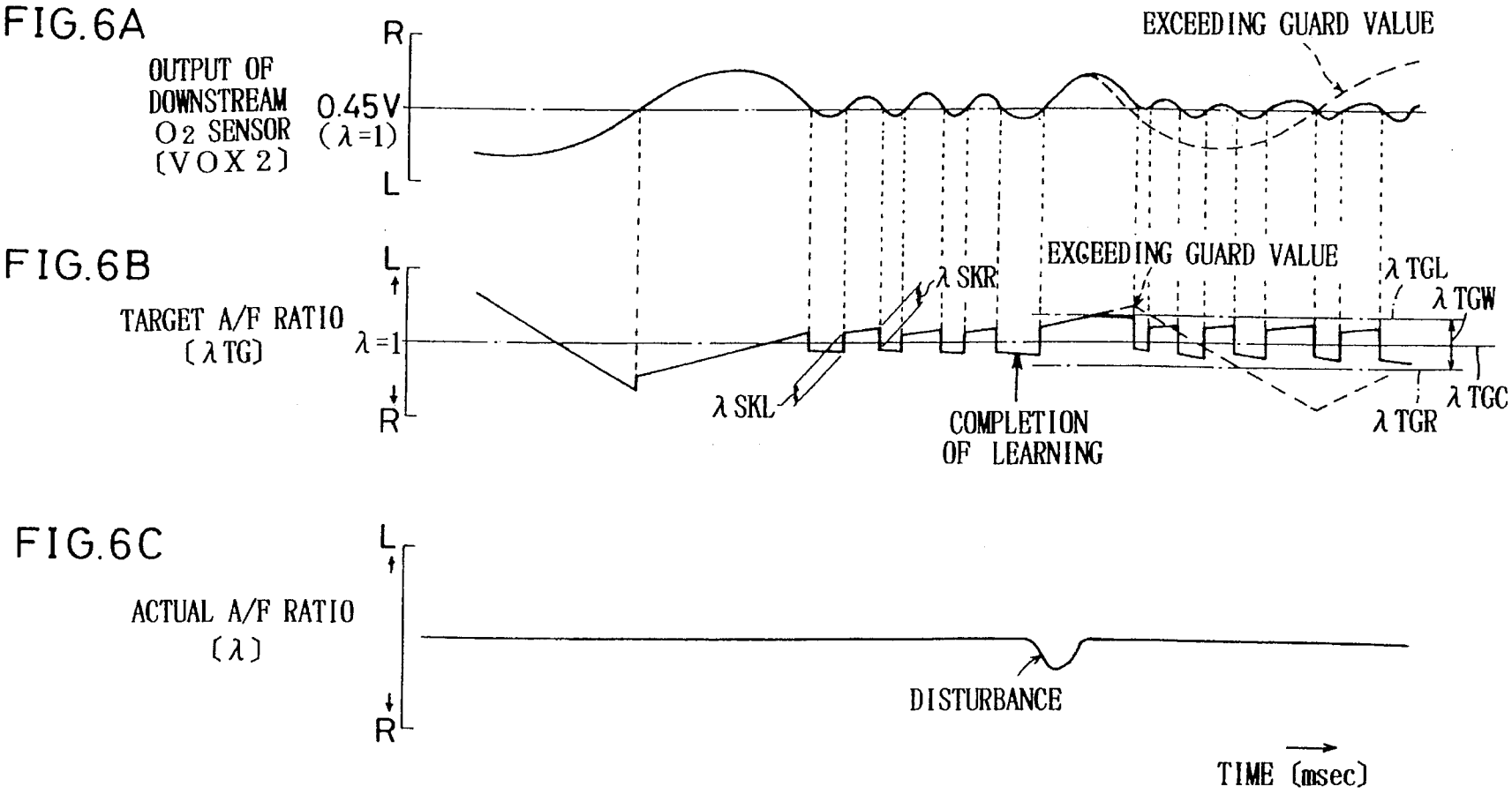
FIGS. 6A through 6C are graphs showing an output voltage of an $O_2$ sensor provided on the downstream side of a three-component catalytic converter and a target air-fuel ratio when the inversion skip is controlled according to the first embodiment of the present invention.

Next, a process for controlling inversion skips executed during the stationary operation will be explained. FIG. 5 is a flowchart showing a routine for controlling inversion skips in the first embodiment of the present invention, and FIGS. 6A through 6C are graphs showing an output voltage VOX2 of the $O_2$ sensor 27 provided on the downstream side of the catalytic converter and the target air-fuel ratio λTG.

Step 201 in FIG. 5 determines whether the output voltage VOX2 of the downstream side $O_2$ sensor 27 is higher or lower (rich or lean) than 0.45 V which is the value when the stoichiometric air-fuel ratio λ=1. If so, Step 202 determines whether the output voltage VOX2 was on the lean side the last time as well. If so, i.e., if the air-fuel ratio λ has been held on the lean side, it is driven to the rich side according to the target air-fuel ratio λTG<–λTG–λIR in Step 203, where λIR is a rich integration amount. On the other hand, if Step 202 determines that the air-fuel ratio was previously on the rich side, i.e. the air-fuel ratio λ has been inverted from the rich side to the lean side, it is driven to the rich side according to the target air-fuel ratio λTG<–λTG–λIR–λSKR in Step 204, where λSKR is a rich skip amount. Because this rich skip amount λSKR is a large value in comparison with the rich integration amount λIR, the target air-fuel ratio λTG drops sharply from the lean side to the rich side as shown in FIG. 6B. Next, a skip counter CSKIP is incremented in Step 205.

Then, after execution of Step 203 or Step 205, Step 206 determines whether learning by a learning routine described later has been finished. When Step 206 determines that the learning has been finished, Step 207 determines whether the target air-fuel ratio λTG is greater than λTGC+λTGW/2, where λTGC is the center value of the target air-fuel ratio which will be described later and λTGW is a guard width which also will be described later. If λTGC>λTGC+λTGW/2, the target air-fuel ratio λTG is set at a guard value of λTGC+λTGW/2 in Step 208. If the result of the comparison in Step 206 or Step 207 is negative, an indication of lean is stored in the RAM 34 as a polarity of the air-fuel ratio λ in Step 216, and this routine is finished. Because this rich integration amount λIR is set as a very small value, the target air-fuel ratio λTG gradually decreases on the rich side as shown in FIG. 6B.

On the other hand, when Step 201 determines that the air-fuel ratio is on the rich side, Step 209 determines whether it was also on the rich side the last time. If so, i.e., if the air-fuel ratio λ has been held on the rich side, it is driven to the lean side according to the target air-fuel ratio λTG<–λTG+λIL, where λIL is a lean integration amount. On the other hand, if the air-fuel ratio was on the lean side last time, i.e., when the air-fuel ratio λ has been inverted from the lean side to the rich side, it is driven to the lean side according to the target air-fuel ratio λTG<–λTG+λIL+λSKL in Step 211, where λSKL is a lean skip amount. Because this lean skip amount λSKL is a large value in comparison with the lean integration amount λIL, the target air-fuel ratio λTG sharply turns to the lean side as shown in FIG. 6B. Then, the skip counter CSKIP is incremented in Step 212.

Then, after execution passes through Step 210 or Step 212, Step 213 determines whether learning has been finished. If so, Step 214 determines whether the target air-fuel ratio λTG is less than λTGC–λTGW/2. When the inequality in Step 214 is satisfied, the target air-fuel ratio λTG is set to a guard value of λTGC–λTGW/2 in Step 215. If one of the equalities in Step 213 or Step 214 is not satisfied, an indication of rich is stored in the RAM 34 as the polarity of the air-fuel ratio λ in Step 216, and this routine is finished.

As described above, when the air-fuel ratio λ of the exhaust gas which passed through the catalytic converter 13 continuously fluctuates to the lean or rich side, the target air-fuel ratio λTG is gradually increased in the opposite direction by the rich integration amount λIR or the lean integration amount λIL in Step 203 or Step 210 based on the output voltage VOX2 of the downstream side $O_2$ sensor 27. Further, when the air-fuel ratio λ is inverted between the lean side and the rich side, the target air-fuel ratio λTG is corrected in a step-like fashion crossing the stoichiometric air-fuel ratio λ=1 by the relatively large rich skip amount λSKR or the relatively lean skip amount λSKL in Step 204 or Step 211. When this occurs, the skip counter is incremented in Step 205 or Step 212.

When the air-fuel ratio is not largely disturbed as described above, the air-fuel ratio of the exhaust gas which passes through the catalytic converter may be controlled well while avoiding a delay caused by the catalytic converter. However, when the air-fuel ratio is largely disturbed and adsorbed substances are accumulated in the catalytic converter, the delay caused by the adsorbed substances may become significant, inviting an overcorrection. Then, in order to prevent overcorrection due the delay of control caused by the adsorbed substances in the catalytic converter, the guards are set for the target air-fuel ratio. The target air-fuel ratio itself fluctuates due to variations in operating parameters and the like between sensors or between cylinders of the engine. However, it does not fluctuate so much by the operating condition and the like and good control may be fully achieved within a narrow range of the fluctuation. The guards in the prior art have been provided for the purpose of compensating for the deterioration or the variance in operating parameters and not for the purpose of preventing overcorrection in the catalytic converter system. Then, guards for preventing overcorrection are provided anew at the point when the learning of the dispersion and the deterioration is finished. Further, although Japanese Patent Application Laid-Open Nos. 61-237852 and 61-265336 try to prevent overcorrection by stopping feedback at a transient state, the catalytic converter is filled with adsorbed substances when feedback returns and it is not possible to avoid overcorrection.

In the flowchart in FIG. 5, Step 206 or Step 213 determines whether the learning has been finished after finishing the calculation of the target air-fuel ratio λTG and when it is not finished, a rich or lean indicator is stored in Step 216. When the learning has been finished, Step 207 or Step 214 determines whether the target air-fuel ratio λTG is within the guard widths. When it is within the guard widths, a rich or lean indicator is stored in Step 216. Thus, overcorrection may be prevented regardless of the mass of the adsorbed substances in the catalytic converter ($O_2$ storage amount). Here, the values of the guard widths are set as relatively small values in comparison with the guard widths for the dispersion or the like.

Figure 7:
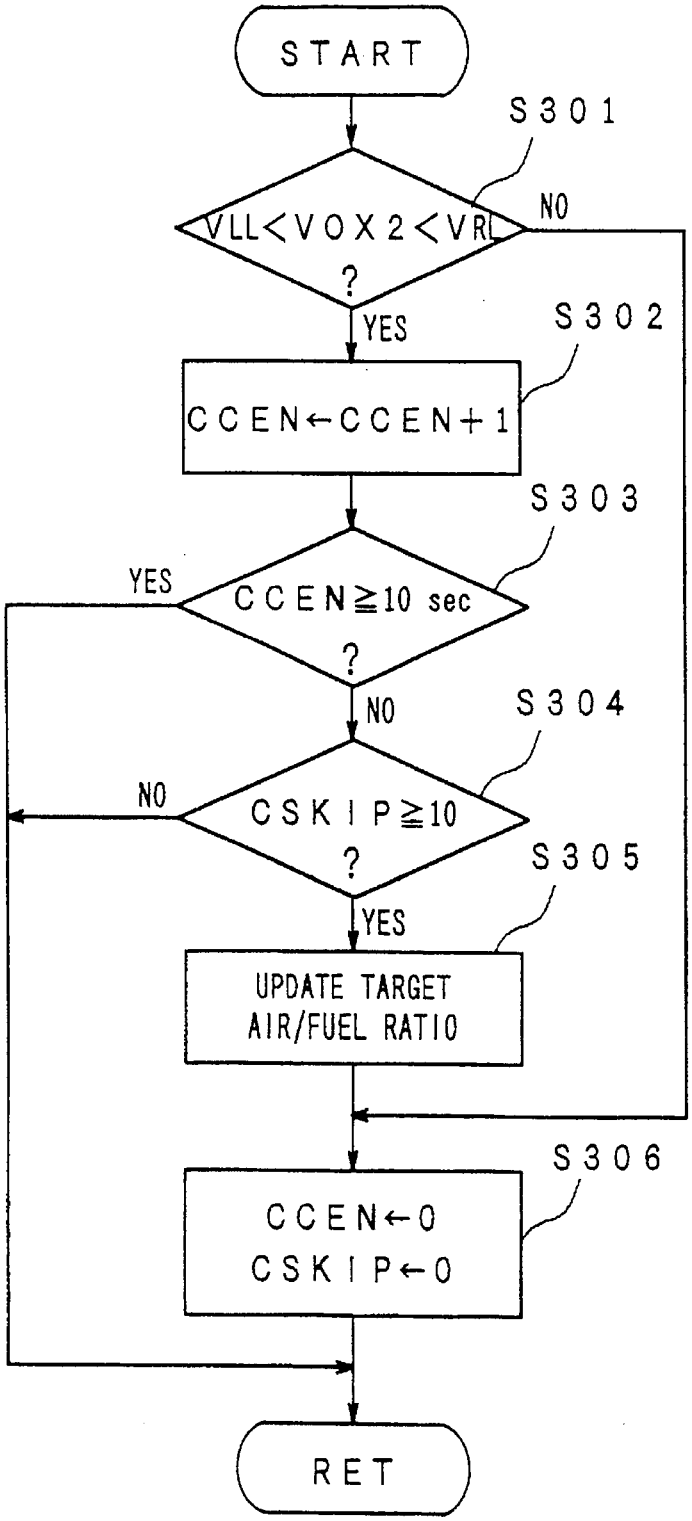
FIG. 7 is a flowchart showing a learning routine of the CPU used in the first embodiment of the present invention.

FIG. 7 is a flowchart showing the learning routine used in the first embodiment of the present invention. Step 301 determines whether the output voltage VOX2 of the downstream side $O_2$ sensor 27 has converged within a range between a predetermined rich side allowable value VRL and a predetermined lean side allowable value VLL (VRL>λ=1>VLL) set in advance. If so, a skip time counter CCEN is incremented in Step 302, assuming that the air-fuel ratio λ on the downstream side of the catalytic converter 13 is stable. Next, Step 303 determines whether the elapsed time period measured by skip time counter CCEN has reached 10 seconds or not. If not, Step 304 determines whether the count of the skip counter CSKIP is greater than 10. When the count of the skip time counter CCEN has reached 10 seconds in Step 303 before the skip counter CSKIP counts reaches 10 in Step 304, this routine is finished. When the number of skips per unit time is thus small, it may be assumed that the air-fuel ratio λ on the downstream side is not frequently inverted between the rich side and the lean side and has not converged around the stoichiometric air=fuel ratio λ=1. That is, the learning process is not executed because it is assumed that the target air-fuel ratio λTG at this time is not a value that can hold the catalytic converter 13 in the neutral state.

On the other hand, when the skip counter CSKIP counts more than 10 in Step 304 before the time measured by the skip time counter CCEN reaches 10 seconds in Step 303, the process is advanced to Step 305. When the number of skips per unit time is thus large, it may be assumed that the air-fuel ratio λ on the downstream side is frequently inverted between the rich side and the lean side and has converged around the stoichiometric air-fuel ratio λ=1. That is, the learning process for calculating the center value of the target air-fuel ratio λTGC which is obtained by adding the target air-fuel ratio just before the skip to the target air-fuel ratio right after the skip and by dividing the result by two is executed, assuming that the target air-fuel ratio λTG at this time is a value that can hold the catalytic converter 13 in the neutral state. Next, the skip time counter CCEN and the skip counter CSKIP are reset in Step 306 and this routine is finished.

Figure 8:
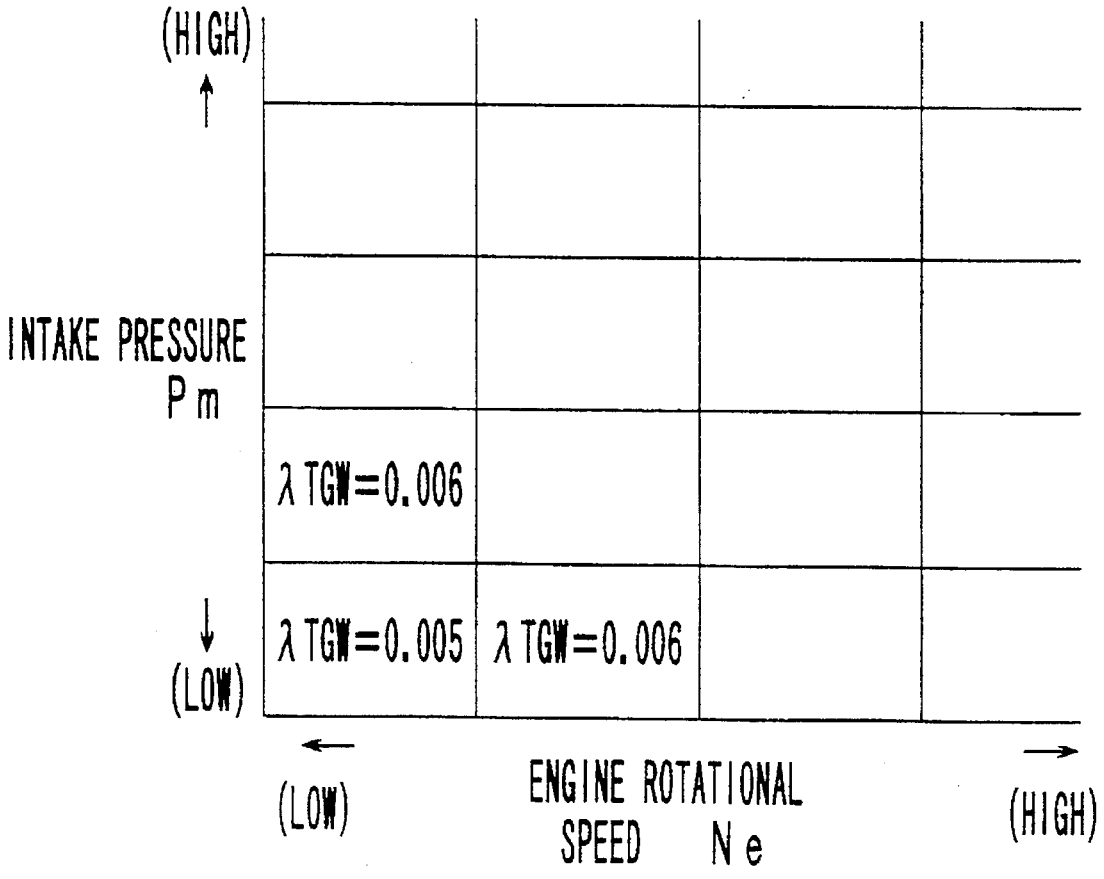
FIG. 8 is a graph showing the relationship between engine speed and intake pressure according to the first embodiment of the present invention.

Thus, as shown in the graphs of FIG. 6A through 6C, the sub-feedback based on the normal output voltage VOX2 of the downstream side $O_2$ sensor 27 is carried out at first, the learning of the target air-fuel ratio λTG is carried out, the center value of the skip is stored as the center value of the target air-fuel ratio λTGC when the learning is finished and then the predetermined guard width λTGW is obtained from a map of engine rotational speed Ne versus intake pressure Pm as shown in FIG. 8. The sum of half of this width and the center value of the target air-fuel ratio λTGC is set as a guard value λTGL on the lean side (upper limit guard) and the difference between the center value and half the width is set as a guard value λTGR on the rich side (lower limit guard). When no guard is provided for the target air-fuel ratio λTG as against a large turbulence of the air-fuel ratio A/F (turbulence of air-fuel ratio) after setting those guard values λTGR and λTGL, a turbulence of the output voltage VOX2 of the downstream side $O_2$ sensor 27 which is indicative of the air-fuel ratio after passing through the catalytic converter becomes large due to the overcorrection and the F/B period is prolonged as shown by broken lines in FIG. 6.

The target air-fuel ratio λTG thus set is used in calculating the air-fuel ratio correction coefficient FAF in Step 104 in the routine for calculating a fuel injection amount described before in connection with FIG. 4. The fuel injection amount TAU is calculated from the air-fuel ratio correction coefficient FAF in Step 105 to control the actual fuel injection amount. Because the routine for calculating the fuel injection amount is executed every 360° CA in synchronization with the rotation of the engine 1 as described above, the air-fuel ratio correction coefficient FAF and the fuel injection amount TAU are also updated every 360° CA and the target air-fuel ratio λTG set in the routine for controlling the inversion skips is reflected immediately in the air-fuel ratio correction coefficient FAF and the fuel injection amount TAU. Accordingly, the fuel injection amount TAU is very responsive to the turbulence of the air-fuel ratio λ detected by the downstream side $O_2$ sensor 27.

As described above, the air-fuel ratio control apparatus of the present embodiment includes an upstream side air-fuel ratio detecting device using by the upstream side $O_2$ sensor 26 provided on the upstream side of the catalytic converter 13 in the exhaust path formed by the exhaust pipe 12 of the engine 1 for detecting an air-fuel ratio of an exhaust gas discharged from the engine 1; a downstream side air-fuel ratio detecting device including the downstream side $O_2$ sensor 27 provided on the downstream side of the catalytic converter 13 for detecting an air-fuel ratio of the exhaust gas which has passed through the catalytic converter; an inversion direction discriminating section for determining an inversion direction of the air-fuel ratio detected by the downstream side air-fuel ratio detecting device when it is inverted and shifted between the rich side and the lean side passing through the stoichiometric air-fuel ratio; a target air-fuel ratio setting section for driving the target air-fuel ratio λTG by a predetermined skip amount in the opposite direction of the air-fuel ratio determined by the inversion direction determining section; an injection amount calculating section for calculating an injection amount of the fuel injection valve 7 at the predetermined updating speed based on the difference between the air-fuel ratio detected by the upstream side air-fuel ratio detecting device and the target air-fuel ratio λTG set by the target air-fuel ratio setting section; a learning section for learning variations in the operating characteristics of the upstream side air-fuel ratio detecting device, the downstream side air-fuel ratio detecting device, the catalytic converter 13 and the engine 1; and a target air-fuel ratio guard setting section for setting the upper and lower limit guard values for the target air-fuel ratio λTG corrected by the target air-fuel ratio setting section after completing the learning by the learning section.

Accordingly, the air-fuel ratio correction coefficient FAF and the fuel injection amount TAU are calculated every 360° CA, the target air-fuel ratio λTG corrected by the rich skip amount λSKR and lean skip amount λSKL is immediately reflected in the air-fuel ratio correction coefficient FAF and the fuel injection amount TAU and the fuel injection amount TAU may be controlled with excellent responsiveness to the turbulence of the air-fuel ratio λ. Further, when the air-fuel ratio λ detected by the downstream side $O_2$ sensor 27 is inverted crossing the stoichiometric air-fuel ratio λ=1, the target air-fuel ratio λTG is driven in a step-like fashion by the rich skip amount λSKR and the lean skip amount λSKL, so that large turbulence in the air-fuel ratio λ on the downstream-side of the catalytic converter 13 thereafter may be reliably suppressed. Further, since the variation in operating characteristics of the upstream side $O_2$ sensor 26, the downstream side $O_2$ sensor 27, the catalytic converter 13 and the engine 1 are learned and the upper and lower limit guard values λTGR and λTGL for the target air-fuel ratio λTG are set after learning, the guard width may be narrowed, thus allowing closer control near the stoichiometric air-fuel ratio.

Therefore, the delay of the correction process on the basis of the output voltage VOX2 of the downstream side $O_2$ sensor 27 for detecting the air-fuel ratio of the exhaust gas which has passed through the catalytic converter 13 may be avoided, the air-fuel ratio may be converged reliably around the stoichiometric air-fuel ratio λ=1, and harmful exhaust components may be prevented from being discharged into the air.

Figure 9:
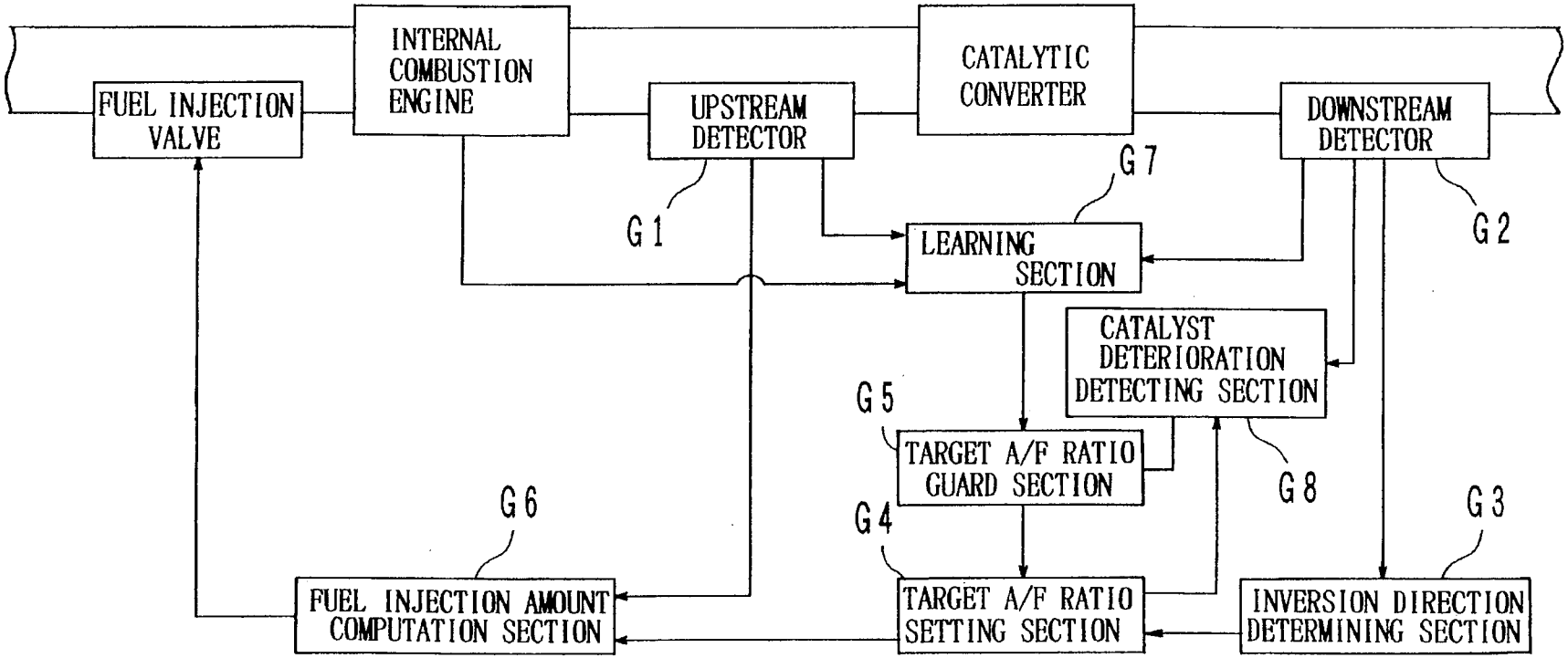
FIG. 9 is a block diagram showing an air-fuel ratio control apparatus for an engine according to a second embodiment of the present invention.

The engine and peripheral devices of a system according to a second embodiment of the present invention are essentially the same as those shown in FIG. 2, and the detailed explanation thereof will be omitted. FIG. 9 is a diagram of the air-fuel ratio control apparatus according to the second embodiment of the present invention, and only points different from the first embodiment will be described hereinbelow.

Figure 10:
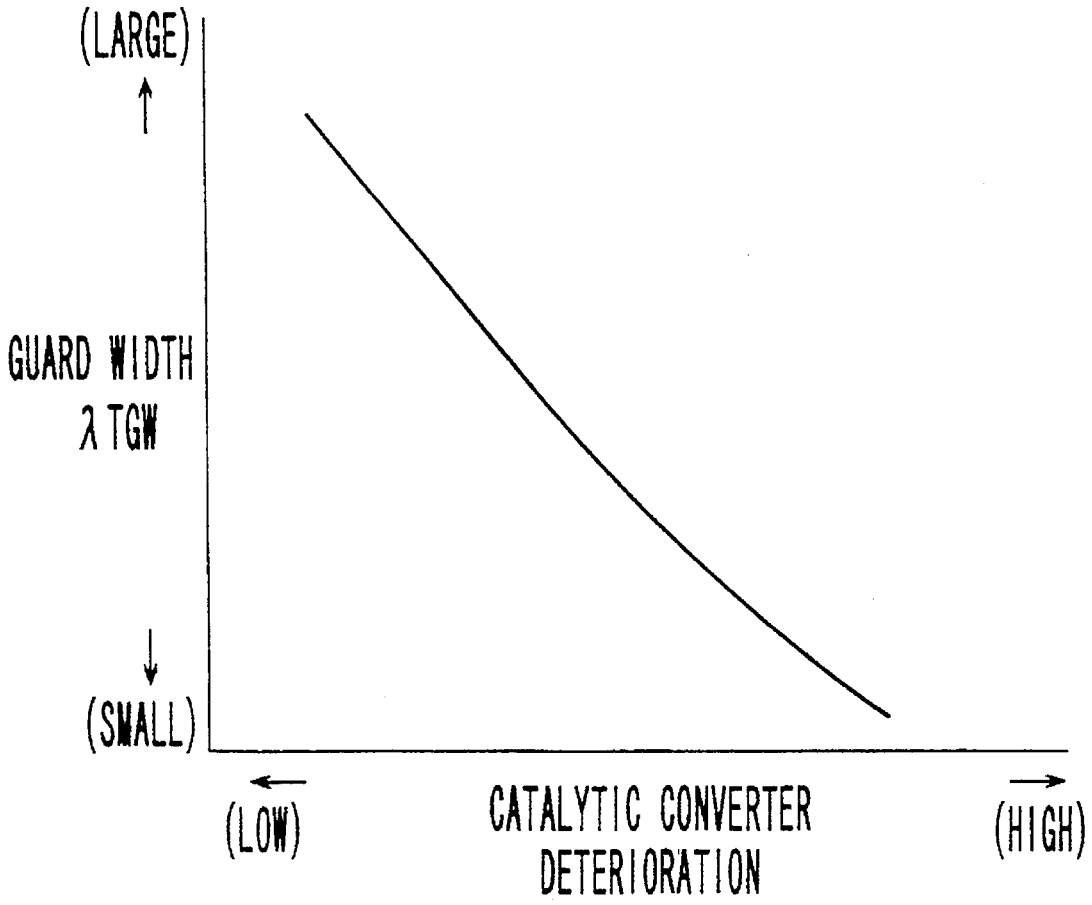
FIG. 10 is a graph showing the relationship between a degree of deterioration of the catalyst in the catalytic converter and the guard width used in the second embodiment of the present invention.

The second embodiment is different from the first embodiment in that a catalyst deterioration detecting section G8 is provided as shown in FIG. 9 to change the guard width λTGW based on the detected result of the deterioration of the catalyst in the catalytic converter. FIG. 10 shows the relationship between the degree of deterioration of the catalytic converter and the guard width.

Next, a routine for detecting the deterioration state of the catalyst will be explained in greater detail.

Figure 11:
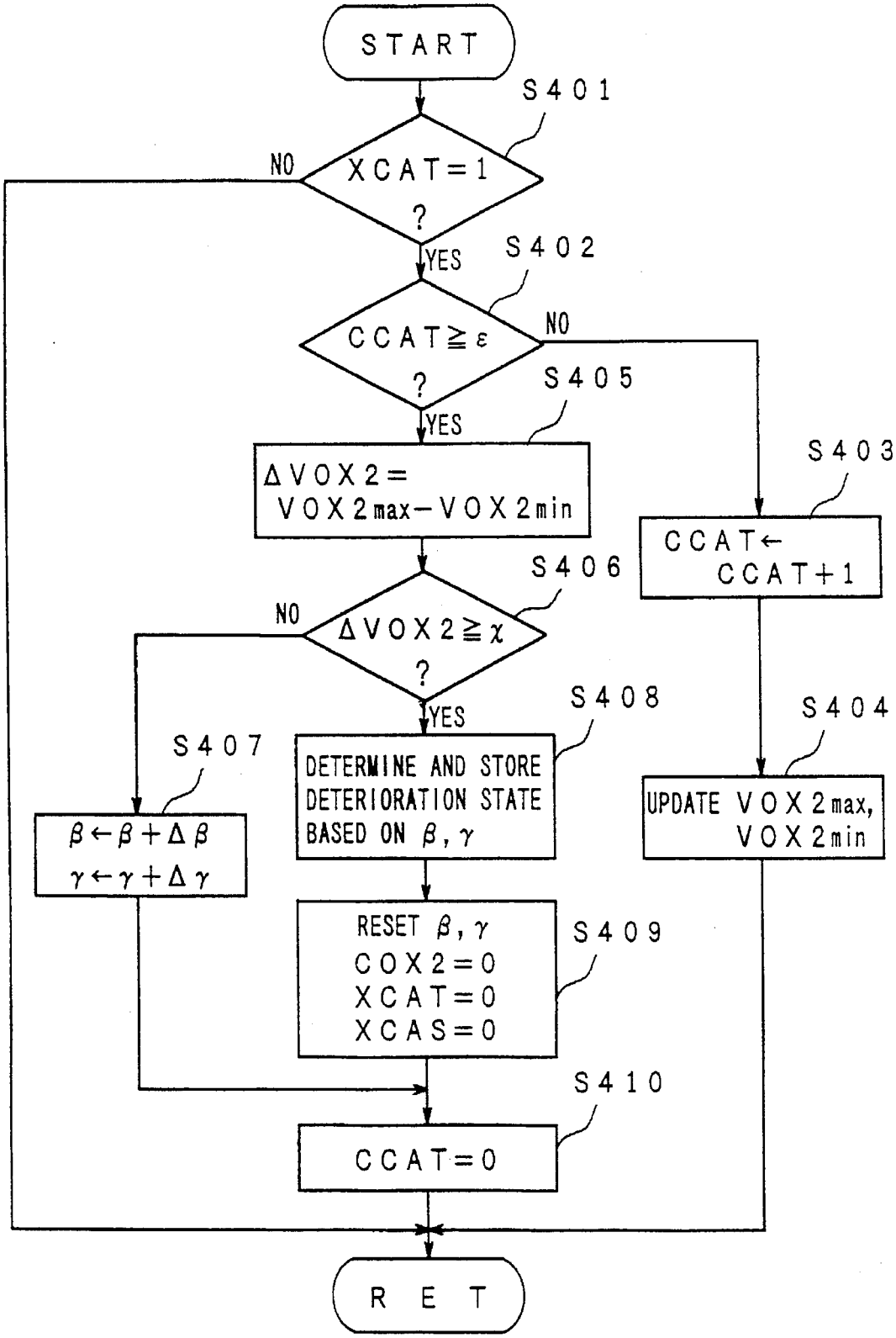
FIG. 11 is a flowchart showing a routine for detecting a deterioration of the catalyst in the three-component catalytic converter according to the second embodiment of the present invention.
Figure 12:
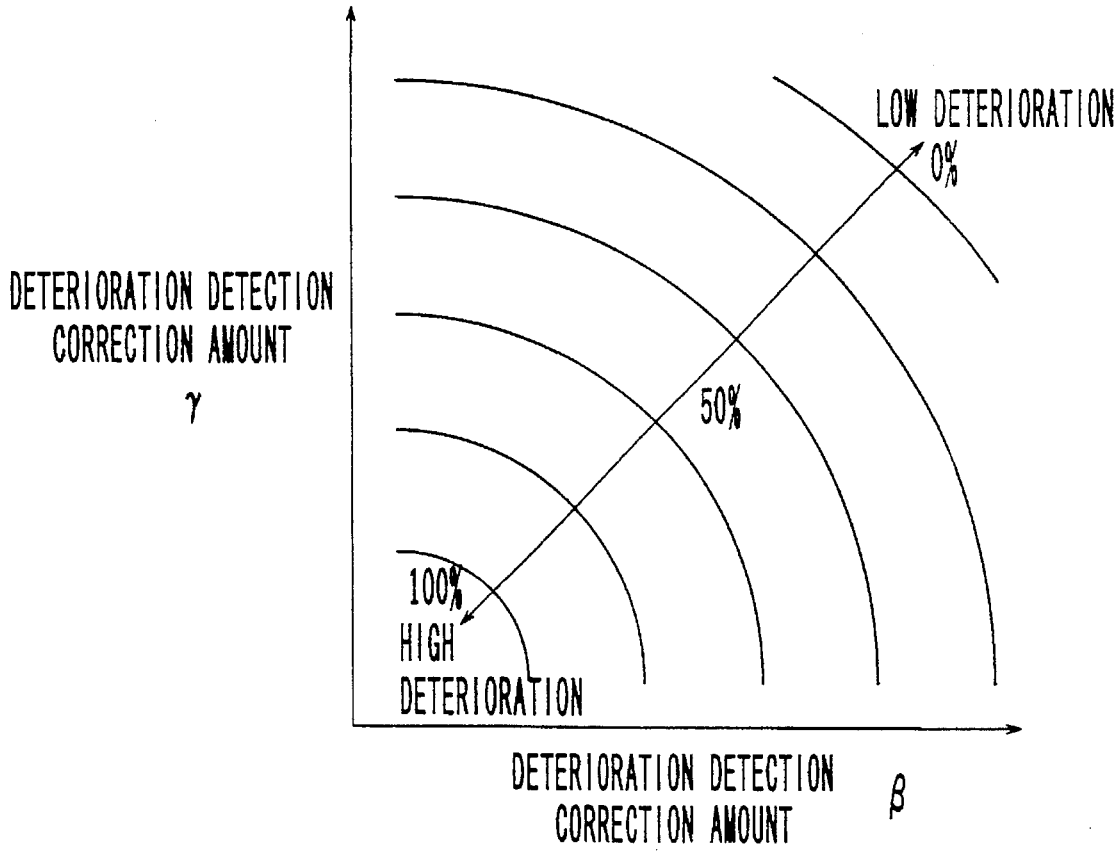
FIG. 12 is a graph for determining the deterioration state of the catalyst from the deterioration detection correction amount according to the second embodiment of the present invention.

FIG. 11 is a flowchart showing the routine for detecting the deterioration of the catalyst according to the second embodiment of the present invention, and FIG. 12 is a graph for determining the deterioration state of the catalyst from the deterioration detection correction amount.

For purposes of the following explanation, assume that a vehicle has travelled a distance of 2,000 km, a deterioration detection executing flag XCAS is set at "1", a standby time counter COX2 for counting a standby time for detecting deterioration of the catalyst has reached a certain value, a dither amplitude λDZA and a dither period TDZA have been incrementally corrected by a routine for controlling an increment of amplitude and period (not shown) and an amplitude and period increment completing flag XCAT is set at "1".

First, Step 401 determines whether the amplitude and period increment completing flag XCAT is set at "1". If not, this routine is finished.

If XCAT=1, Step 402 determines whether a continuation time counter CCAT indicates that a period greater than a predetermined continuation time ε has elapsed. If not, the continuation time counter CCAT is incremented in Step 403. In Step 404, the output voltage VOX2 of the downstream side $O_2$ sensor 27 is sampled to adequately update the maximum value $VOX2_{max}$ and the minimum value $VOX_{min}$ thereof. Then, this routine is finished.

On the other hand, when the inequality in Step 402 is satisfied, Step 405 calculates a deviation ΔVOX2 by subtracting the minimum value $VOX2_{min}$ from the maximum value $VOX2_{max}$. This deviation ΔVOX2 represents the fluctuation state of the air-fuel ratio λ on the downstream side of the catalytic converter 13 during the continuation time ε. Next, Step 406 determines whether the deviation ΔVOX2 is greater than a fluctuation determination value σ. If not, it is assumed by the fluctuation of the air-fuel ratio λ that the catalytic converter 13 has not yet reached a saturation state, a predetermined value Δβ is added to the deterioration detection correction amount β, and a predetermined value Δγ is added to a deterioration detection correction amount γ.

When the fluctuation state of the air-fuel ratio λ thus gradually increases every time when the continuation time λ passes, the amount of harmful components adsorbed by the catalytic converter 13 increases accordingly and the inequality in Step 406 is satisfied when this happens, the deterioration state of the catalyst is determined from the deterioration detection correction amounts β and γ at that time in accordance with the graph shown in FIG. 12 and is stored in the RAM 34 in Step 408. That is, because it means that the earlier the catalytic converter 13 saturates when the deterioration detection correction amounts ∂ and γ are small, the greater its deterioration state then the smaller the deterioration detection correction amounts ∂ and γ during saturation, the greater the deterioration state, as shown in FIG. 12. In the present embodiment, the deterioration state is determined quantitatively as a percentage and the greater the deterioration state, the larger the percentage value.

Next, the deterioration detection correction amounts ∂ and γ are reset to their initial values and the standby counter COX2 for counting the standby time suited to detect deterioration of the catalyst, the amplitude and period increment completing flag XCAT and the deterioration detection executing flag XCAS are also reset in Step 409. Then, after the processing in Steps 407 and 409, the continuation time counter CCAT is reset in Step 410 and this routine is finished. Thus, the deterioration state of the catalyst is determined and the guard width λTGW is obtained and changed based on the degree of deterioration of the catalyst.

As described above, the air-fuel ratio control apparatus of the second embodiment includes an upstream side air-fuel ratio detecting device including the upstream side $O_2$ sensor 26 provided on the upstream side of the catalytic converter 13 in the exhaust path formed by the exhaust pipe 12 of the engine 1 for detecting an air-fuel ratio of an exhaust gas discharged from the engine 1; a downstream side air-fuel ratio detecting device including the downstream side $O_2$ sensor 27 provided on the downstream side of the catalytic converter 13 for detecting an air-fuel ratio of the exhaust gas which has passed through the catalytic converter; an inversion direction determining section for determining an inversion direction of the air-fuel ratio detected by the downstream side air-fuel ratio detecting device when it is inverted and shifted between the rich and lean sides passing through the stoichiometric air-fuel ratio; a target air-fuel ratio setting section for correcting the target air-fuel ratio λTG in a step-like fashion by the skip amount set in advance in the opposite direction of the air-fuel ratio determined by the inversion direction determining section; a target air-fuel ratio guard setting section for setting the upper and lower limit guard values for the target air-fuel ratio λTG corrected by the target air-fuel ratio setting section based on the mass of adsorbed substances in the catalytic converter 13; an injection amount calculating catalyst for calculating an injection amount of the fuel injection valve 7 at a predetermined updating speed based on the difference between the air-fuel ratio detected by the upstream side air-fuel ratio detecting device and the target air-fuel ratio λTG set by the target air-fuel ratio setting section; a learning section for learning variations in the operating characteristics of the upstream side air-fuel ratio detecting device, the downstream side air-fuel ratio detecting device, the catalytic converter 13 and the engine 1; and a catalyst deterioration detecting section for detecting the deterioration state of the catalyst and, based on that result, for increasing or decreasing the guard width λTGW of the upper and lower limit guards λTGR and λTGL.

Accordingly, the air-fuel ratio correction coefficient FAF and the fuel injection amount TAU are calculated every 360° CA, the target air-fuel ratio λTG corrected by the rich skip amount λSKR and lean skip amount λSKL is reflected immediately in the air-fuel ratio correction coefficient FAF, and the fuel injection amount TAU may be controlled with excellent responsiveness to the turbulence of the air-fuel ratio λ. Further, when the air-fuel ratio λ detected by the downstream side $O_2$ sensor 27 is inverted crossing the stoichiometric air-fuel ratio λ=1, the target air-fuel ratio λTG is driven in a step-like fashion by the rich skip amount λSKR and the lean skip amount λSKL, so that large turbulence of the air-fuel ratio λ on the downstream side of the catalytic converter 13 may be reliably suppressed. Further, because the upper and lower limit guards λTGR and λTGL for the target air-fuel ratio λTG are set based on the mass of adsorbed substances of the catalytic converter 13 and are set after learning variations in operating characteristics of the upstream side $O_2$ sensor 26, the downstream side $O_2$ sensor 27, the catalytic converter 13 or the engine 1, the guard width may be narrowed. Further, the guard width between the upper and lower limit guards λTGR and λTGL is increased or decreased based on the detected result of the deterioration state of the catalyst, an adequate guard width which follows changes of the deterioration state of the catalyst may be set. That is, the maximum adsorption amount of the catalytic converter 13 is changed corresponding to the deterioration state thereof and when the catalytic converter 13 is new and the maximum adsorption amount is large, the guard width λTGW is increased. Thereby, the adsorbed substances may be quickly purged, thus permitting rapid stabilization of the air-fuel ratio after the catalytic converter.

Therefore, the delay of the correction process on the basis of the output voltage VOX2 of the downstream side $O_2$ sensor 27 for detecting the air-fuel ratio of the exhaust gas which has passed through the catalytic converter 13 may be avoided, the air-fuel ratio may be more reliably converged around the stoichiometric air-fuel ratio λ=1, and harmful components may be prevented from being discharged into the air.

The engine and peripheral devices in which the air-fuel ratio control apparatus according to a third embodiment of the present invention is used are largely the same as those shown in FIG. 2, and the detailed explanation thereof will be omitted. Only points different from the first embodiment will be described hereinbelow.

The third embodiment is different from the first embodiment in that when the target air-fuel ratio λTG shown in FIG. 6B has not returned within a predetermined time after reaching the upper and lower limit guards λTGL and λTGR and the time during which the target air-fuel ratio λTG touches the upper and lower limit guards λTGL and λTGR is long, it is returned to the center value of the target air-fuel ratio λTGC which is the original average value (i.e., the learned value). This is because overcorrection by the catalytic converter 13 results if the output of the downstream side $O_2$ sensor 27 is left continuously on the lean (L) side or the rich (R) side for more than a predetermined amount of time.

Next, a process for controlling inversion skips and a process for returning to the learned value calculated during the stationary operation will be explained.

Figure 13:
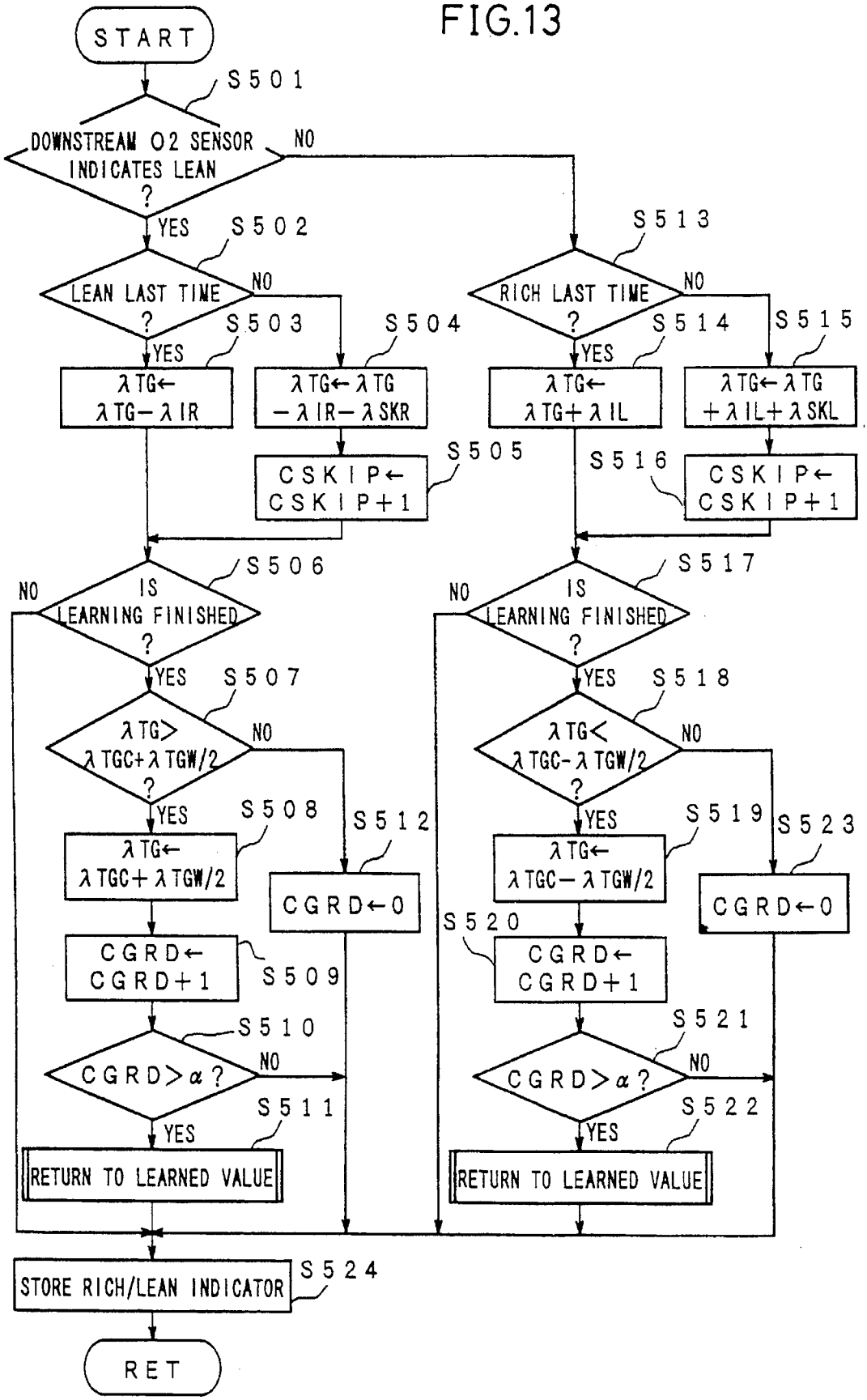
FIG. 13 is a flowchart showing a routine for controlling inversion skips according to a third embodiment of the present invention.
Figure 14:
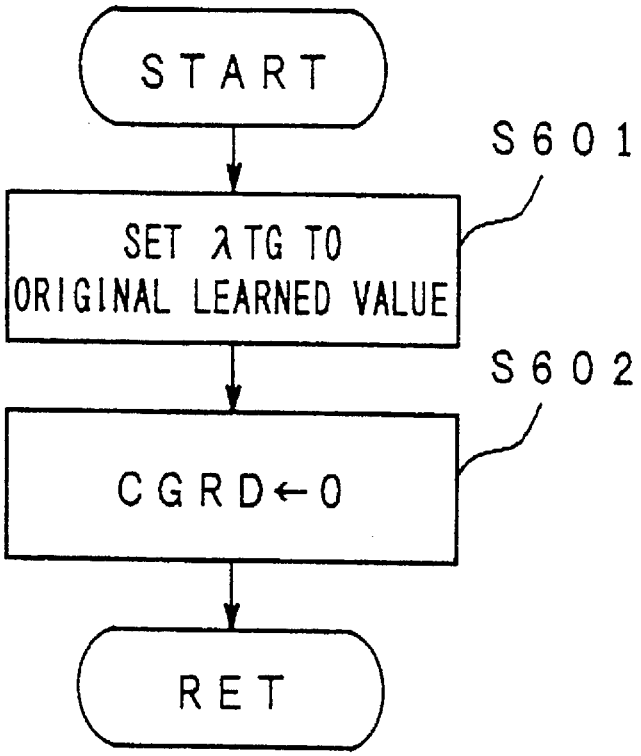
FIG. 14 is a flowchart showing a routine for returning to the learned value in FIG. 13.

FIG. 13 is a flowchart showing a routine for controlling inversion skips according to a third embodiment of the present invention, and FIG. 14 is a routine for returning to the learned value in FIG. 13. In FIG. 13, as compared to the flowchart in FIG. 5, Steps 509, 510 and 511 are added after Step 508; when the inequality in Step 507 is not satisfied, Step 512 is added; and when the inequality in Step 510 is not satisfied, Step 511 is skipped. Similarly, Steps 520, 521 and 522 are added after Step 519; when the inequality in Step 518 is not satisfied, a process of Step 523 is added; and when the inequality in Step 521 is not satisfied, Step 522 is skipped.

Figure 15:
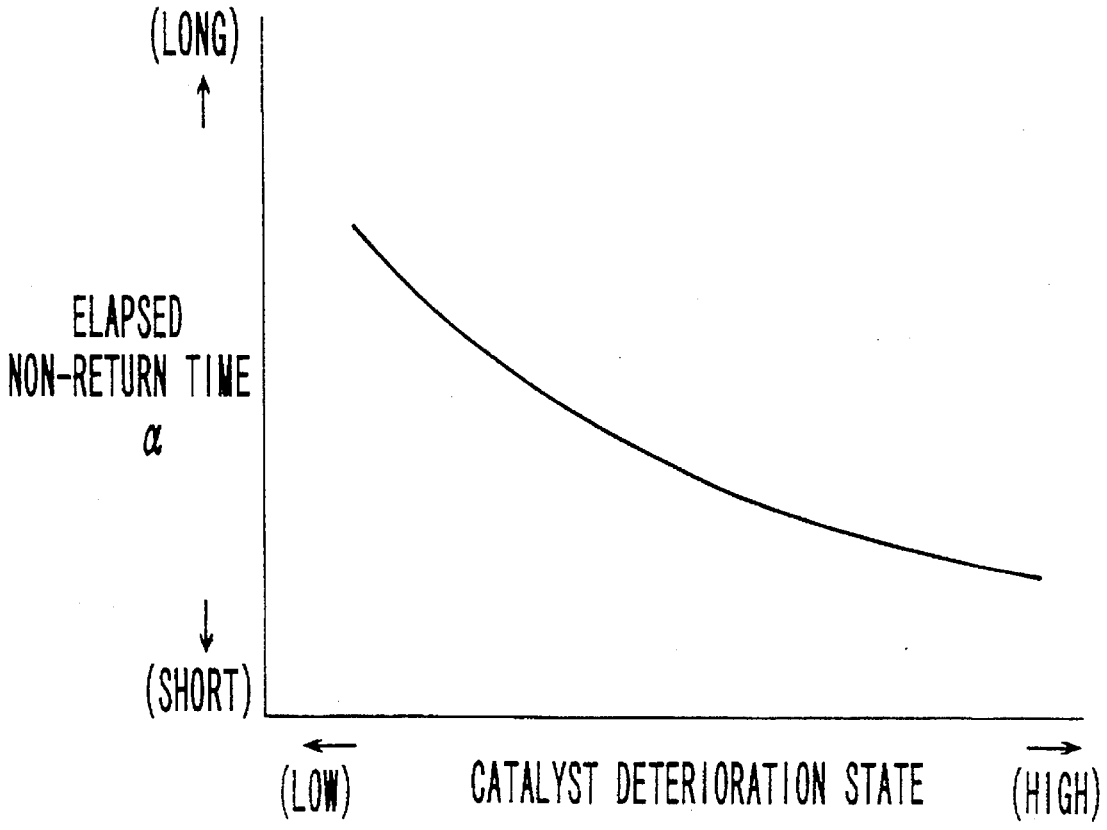
FIG. 15 is a graph showing a relationship between a deterioration state of the catalyst and a predetermined time according to the third embodiment of the present invention.

Only the steps in FIG. 13 added to the flowchart in FIG. 5 will be explained hereinbelow. In FIG. 13, when it is determined that the air-fuel ratio λ has reached one of the guard values, the counter CGRD is incremented in Step 509 and the contents of counter CGRD is compared with the predetermined time α in Step 510 or 521. When the contents of CGRD exceeds α, the flowchart in FIG. 14 is executed as the process for returning to the learned value in Step 511 or 522 to return the target air-fuel ratio λTG to the center value of target air-fuel ratio λTGC which is the original average value. Then the counter CGRD is reset in Step 602. It should be noted that it is possible to return to the learned value when the target air-fuel ratio is returned from the guard value in the first embodiment. Further, the predetermined time α may be changed corresponding to the deterioration state of the catalytic converter found in the second embodiment described above. FIG. 15 shows a relationship between the deterioration state of the catalytic converter and the predetermined time α. As is apparent from the graph, the predetermined time α is selected so that the newer the catalytic converter, the less likely overcorrection is to occur.

As described above, the air-fuel ratio control apparatus of the third embodiment is designed so that the target air-fuel ratio setting section forcibly returns the target air-fuel ratio to the center value of the target air-fuel ratio λTGC which is the learned value if the target air-fuel ratio has not returned to the center value within a predetermined time after reaching either of the upper or lower limit guard values λTGL and λTGR.

The air-fuel ratio control apparatus of the present embodiment sets the predetermined time to be shorter as the catalytic converter 13 deteriorates. Accordingly, the time during which the target air-fuel ratio λTG touches either the upper or lower limit guard values λTGL or λTGR will not exceed the predetermined time. Further, the predetermined time is adequately changed corresponding to the deterioration state of the catalytic converter 13.

Therefore, whether the catalytic converter 13 is new or old is also taken into account, and an overcorrection state in which the air-fuel ratio λ deviates from the target air-fuel ratio λTG for a long period of time will not occur.

The engine and peripheral devices according to a fourth embodiment of the present invention are largely the same as those shown in FIG. 2, and the detailed explanation thereof will be omitted. Only points different from the first embodiment will be described hereinbelow.

The fourth embodiment is different from the first embodiment in that a re-learning setting section is provided to start learning again if the output voltage VOX2 from the downstream side $O_2$ sensor 27 has not returned to a predetermined value (or a value within a predetermined range) after finishing the learning by the learning section.

Figure 16:
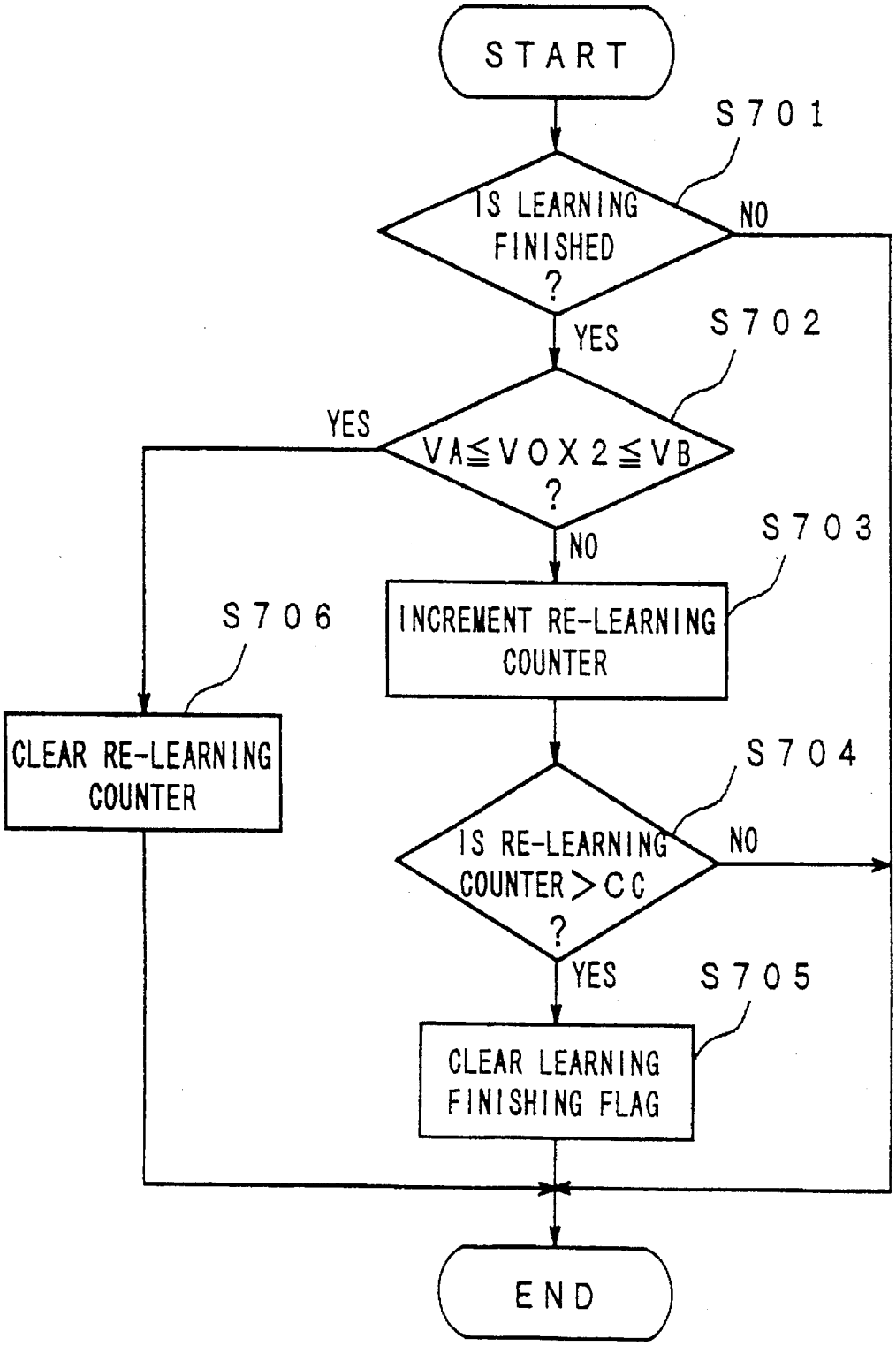
FIG. 16 is a flowchart showing a routine for setting re-learning according to a fourth embodiment of the present invention.

FIG. 16 is a flowchart showing a routine for setting re-learning according to the fourth embodiment of the present invention. It should be noted that this routine for setting re-learning is executed synchronously with the detection of the downstream side $O_2$ sensor 27 provided on the downstream side of the catalytic converter 13.

First, Step 701 determines whether the learning has been finished. If so, it is Step 702 determines whether the output VOX2 is within the predetermined range (VA≦VOX2≦VB). When VOX2 is not within the predetermined range, a re-learning counter is incremented in Step 703. When Step 704 determines that re-learning counter exceeds a predetermined value Cc, a learning finishing flag is cleared in Step 705. On the other hand, when Step 704 determines that VOX2 is within the predetermined range, the re-learning counter is cleared in Step 706 and this routine is finished. When the determination conditions in either of Step 701 or Step 704 is not satisfied, this routine is finished.

As described above, the air-fuel ratio control apparatus of the present embodiment comprises an upstream side air-fuel ratio detecting device including the upstream side $O_2$ sensor 26 provided on the upstream side of the catalytic converter 13 in the exhaust path formed by the exhaust pipe 12 of the engine 1, for detecting an air-fuel ratio of exhaust gas discharged from the engine 1; downstream side air-fuel ratio detecting device including the downstream side $O_2$ sensor 27, provided on the downstream side of the catalytic converter 13, for detecting an air-fuel ratio of the exhaust gas which has passed through the catalytic converter; an inversion direction determining section for determining an inversion direction of the air-fuel ratio detected by the downstream side air-fuel ratio detecting device when it is inverted and shifted between the rich side and the lean side passing through the stoichiometric air-fuel ratio; a target air-fuel ratio setting section for correcting the target air-fuel ratio λTG in a step-like fashion by a predetermined skip amount set to the opposite direction of the air-fuel ratio determined by the inversion direction determining section; a target air-fuel ratio guard setting section for setting the upper and lower limit guard values for the target air-fuel ratio λTG corrected by the target air-fuel ratio setting section based on the mass of adsorbed substances in the catalytic converter 13; an injection amount calculating section for calculating an injection amount of the fuel injection valve 7 at a predetermined updating speed based on the difference between the air-fuel ratio detected by the upstream side air-fuel ratio detecting device and the target air-fuel ratio λTG set by the target air-fuel ratio setting section; a learning section for learning variations in operating characteristics of the upstream side air-fuel ratio detecting device, the downstream side air-fuel ratio detecting device, the catalytic converter 13 and the engine 1; and a re-learning section for re-learning if the value from the downstream side air-fuel ratio detecting device has not returned to the predetermined value after finishing learning by the learning section.

Accordingly, the air-fuel ratio correction coefficient FAF and the fuel injection amount TAU are calculated every 360° CA, the target air-fuel ratio λTG corrected by the rich skip amount λSKR and lean skip amount λSKL is reflected immediately in the air-fuel ratio correction coefficient FAF, and the fuel injection amount TAU may be controlled with excellent responsiveness to the turbulence of the air-fuel ratio λ. Further, when the air-fuel ratio λ detected by the downstream side $O_2$ sensor 27 is inverted crossing the stoichiometric air-fuel ratio λ=1, the target air-fuel ratio λTG is corrected in a step-like fashion by the rich skip amount λSKR and the lean skip amount λSKL, so that large turbulence of the air-fuel ratio λ on the downstream side of the catalytic converter 13 thereafter may be reliably suppressed. Further, because the upper and lower limit guard values λTGR and λTGL for the target air-fuel ratio λTG are set based on the mass of adsorbed substances of the catalytic converter 13 and are set after learning variations in operating characteristics of the upstream side $O_2$ sensor 26, the downstream side $O_2$ sensor 27, the catalytic converter 13 and the engine 1, the guard width may be narrowed. In addition to that, learning is carried out again if the output voltage VOX2 from the downstream side $O_2$ sensor 27 has not returned to a predetermined value after finishing learning, so that fluctuation of the learned value is adequately corrected. Due to that, the reliability of the learned value is increased, and the air-fuel ratio can always be controlled near the stoichiometric air-fuel ratio.

Therefore, the delay of the correction process on the basis of the output voltage VOX2 of the downstream side $O_2$ sensor 27 for detecting the air-fuel ratio of the exhaust gas which has passed through the catalytic converter 13 may be avoided, the air-fuel ratio may be always and reliably converged around the stoichiometric air-fuel ratio λ=1, and harmful components may be prevented from being discharged into the air.

The engine and peripheral devices in which the air-fuel ratio control apparatus according to a fifth embodiment of the present invention is used are the same as those shown in FIG. 2, and a detailed explanation thereof will be omitted. Only points different from the third embodiment will be described hereinbelow.

A process for controlling inversion skips and a process for returning to a learned value calculated during the stationary operation will be explained.

Figure 17:
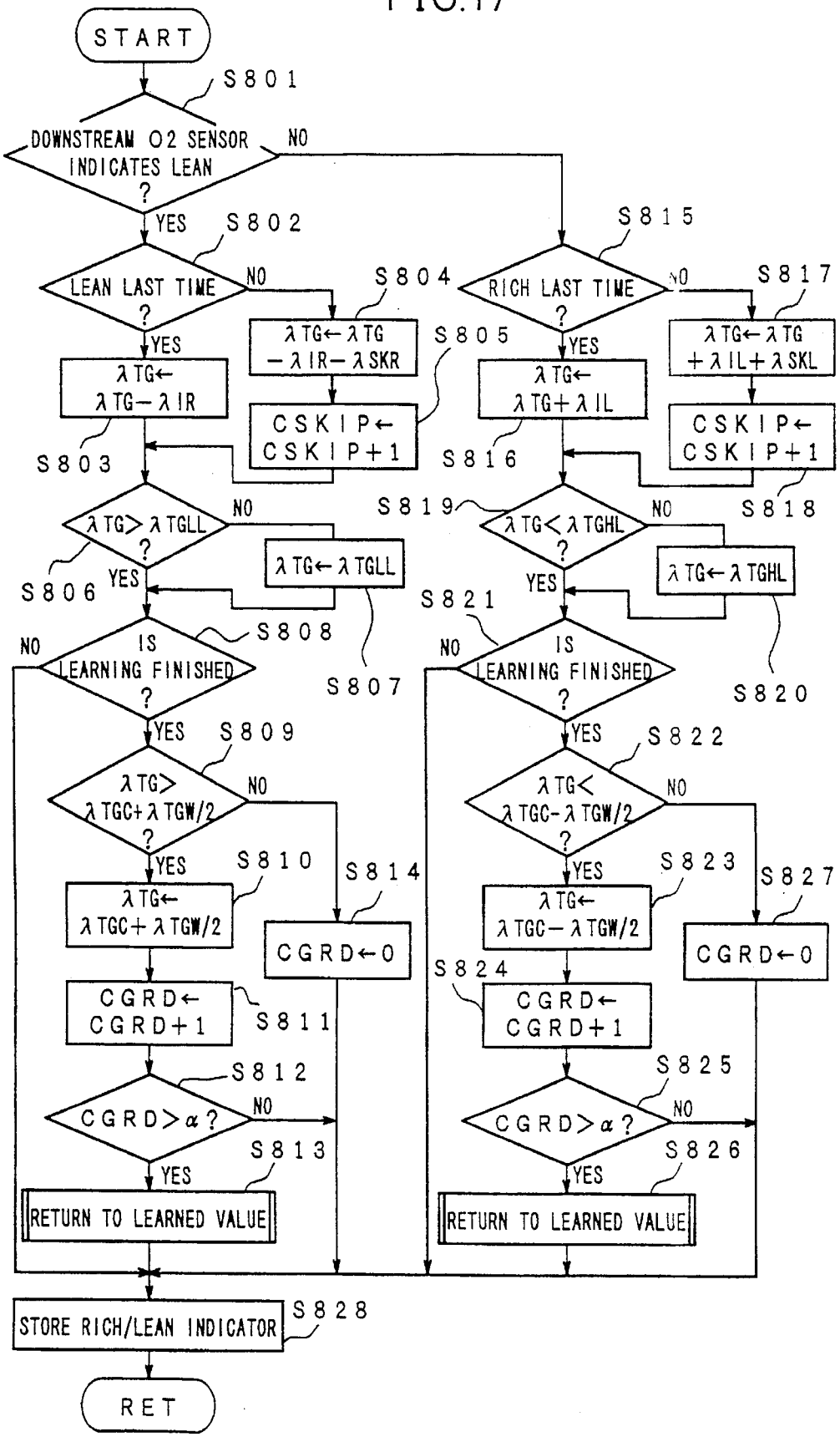
FIG. 17 is a flowchart showing a routine for controlling inversion skips according to a fifth embodiment of the present invention.

FIG. 17 is a flowchart showing a routine for controlling the inversion skips according to the fifth embodiment of the present invention. In FIG. 17, as compared to the flowchart in FIG. 13 in the third embodiment, Step 803 is added after Step 803 or 805 and when the inequality in Step 806 is not satisfied, Step 807 is added. Similarly, Step 819 is added after Step 816 or 818 and when the inequality in Step 819 is not satisfied, Step 820 is added. A routine for returning to learned value in FIG. 17 is the same as that in FIG. 14 and a detailed explanation thereof will be omitted.

Only the steps in FIG. 17 added to the flowchart in FIG. 13 will be explained hereinbelow. In FIG. 17, after the process in Step 803 or 805, Step 806 determines whether the target air-fuel ratio λTG is on the side of the center value within a predetermined wide guard value λTGLL (lower limit guard) on the rich side of the downstream side $O_2$ sensor 27 (see FIGS. 18A through 18C). If not, and the target air-fuel ratio λTG deviates less than the guard value λTGLL, the guard value λTGLL is determined to be the target air-fuel ratio λTG in Step 807. Then, the process is shifted to Step 808 after Step 806 or Step 807.

Further, Step 816 or Step 818 is executed, Step 819 determines whether the target air-fuel ratio λTG is on the side of the center value within a predetermined wide guard value λTGHL (upper limit guard) set in advance on the lean side of the downstream side $O_2$ sensor 27 (see FIG. 18). If not, and the target air-fuel ratio λTG deviates more than the guard value λTGHL, the guard value λTGHL is determined to be the target air-fuel ratio λTG. Then the process is shifted to Step 821 after Step 819 or Step 820.

Figures 18A, 18B, 18C:
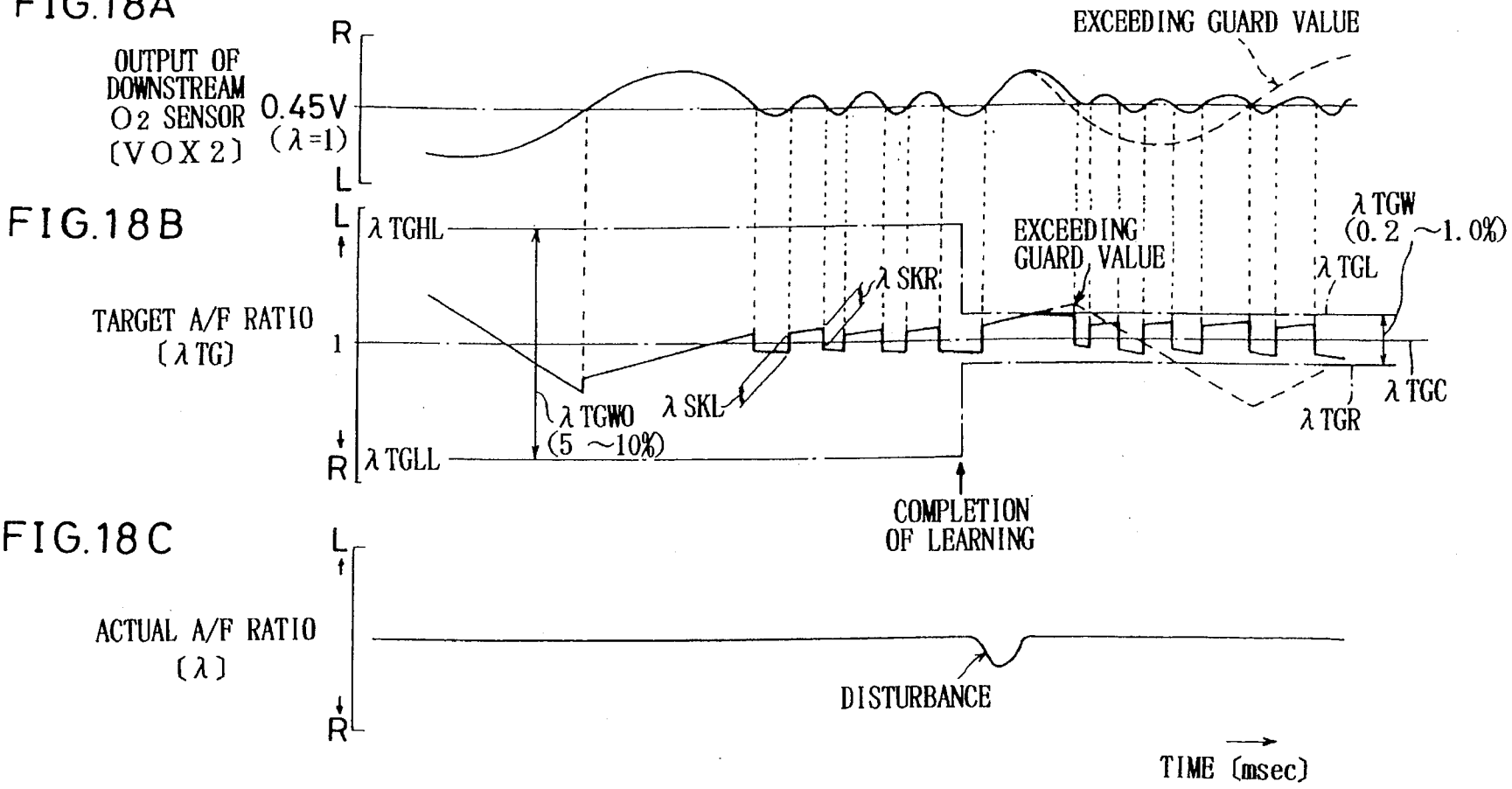
FIGS. 18A through 18C are graphs showing an output voltage of an $O_2$ sensor provided on the downstream side of the catalytic converter and a target air-fuel ratio when the inversion skips are controlled according to the fifth embodiment of the present invention.
Figures 19A, 19B:
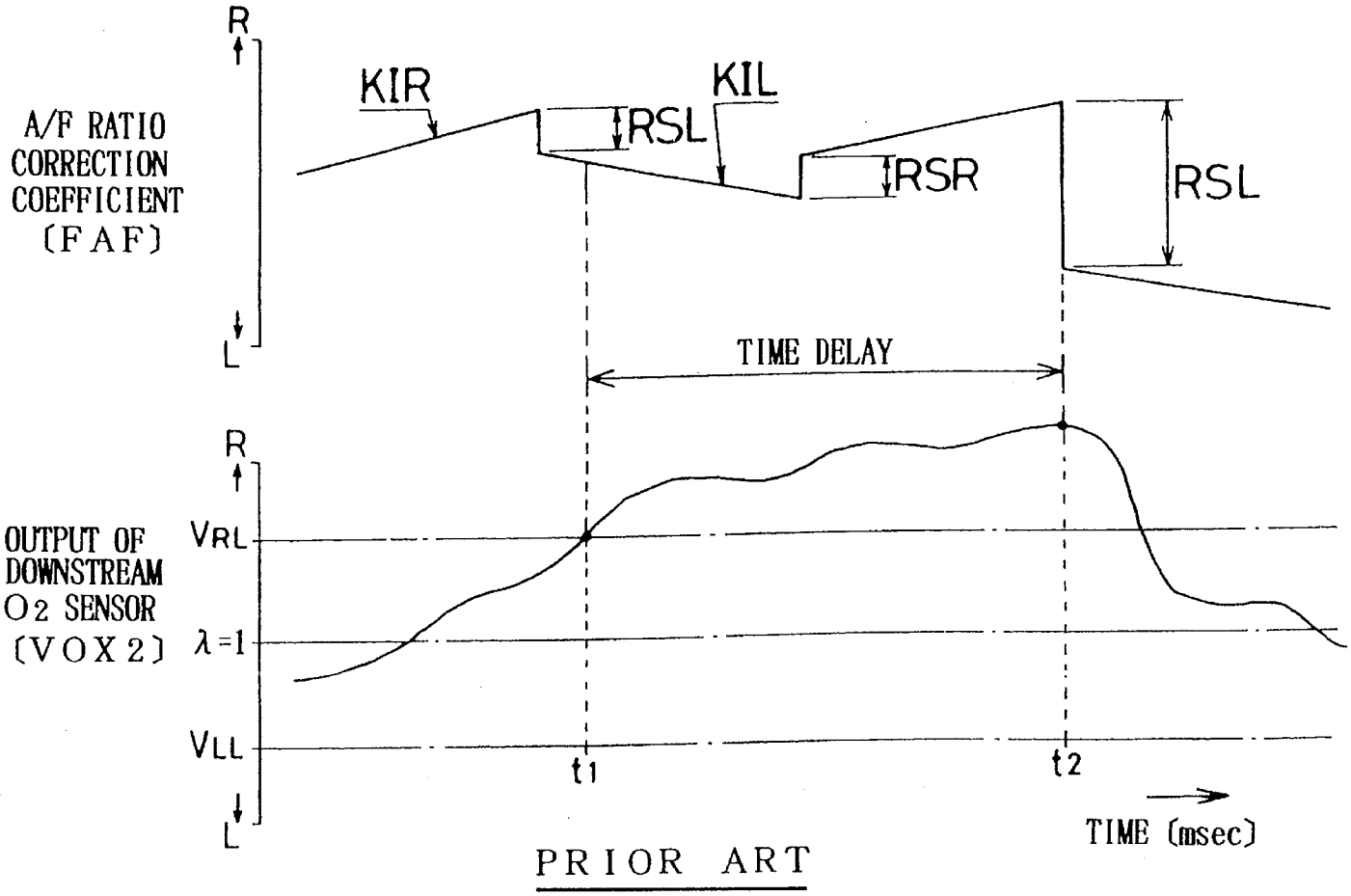
PRIOR ART FIG.19A
FIGS. 19A and 19B are graphs showing an air-fuel ratio correction coefficient and an output voltage of an $O_2$ sensor on the downstream side according to a prior art air-fuel ratio control apparatus.
Figures 20A, 20B:
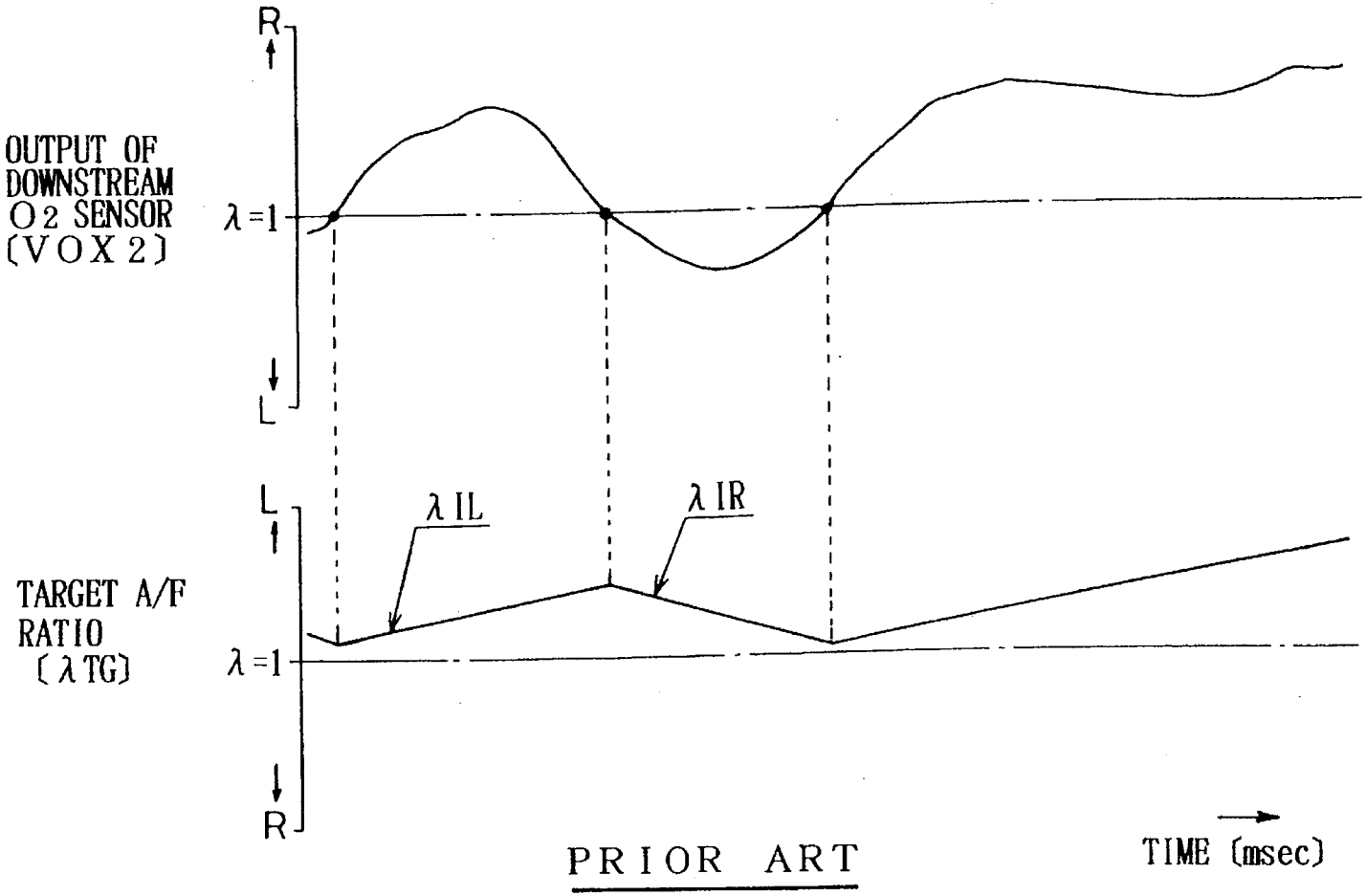
FIG.20B PRIOR ART
FIGS. 20A and 20B are graphs showing an output voltage of an $O_2$ sensor provided on the downstream side of a catalytic converter and a target air-fuel ratio according to another prior art air-fuel ratio control apparatus.

That is, the fifth embodiment is different from the third embodiment in that the upper and lower limit guard width λTGWO is set in advance to be 5–10% the target air-fuel ratio λTG taking the dispersion of the upstream side $O_2$ sensor 26, the downstream side $O_2$ sensor 27, the catalytic converter 13 and the engine 1 into account as shown in FIGS. 18A through 18C, and this upper and lower limit guard width λTGWO is changed to the narrow upper and lower limit guard width λTGW which is 0.2 to 1.0% of the target air-fuel ratio λTG at the timing when the learning is finished.

In prior art systems, the response of the downstream side $O_2$ sensor 27 is delayed a great deal from changes in the actual air-fuel ratio and the state of the catalytic converter due to the adsorption and desorption reactions of the catalytic converter 13. As a result, the deterioration in quality of emissions due to overcorrection cannot be avoided when feedback control of the air-fuel ratio is based only on the signal from the downstream side $O_2$ sensor 27. However, the deterioration of emissions due to overcorrection may be prevented by setting appropriate upper and lower limit guards for the correction of the air-fuel ratio by the downstream side $O_2$ sensor 27. Because the air-fuel ratio may not converge on the target value due to deterioration of the catalytic converter and the dispersion if the control range of the target air-fuel ratio is set narrowly in advance, the widely-set upper and lower limit guards are narrowed after the downstream side $O_2$ sensor 27 detects that the air-fuel ratio will become a more or less stable value. Thereby, the improvement of the convergence against deterioration and variations in the operating characteristics of the upstream side $O_2$ sensor 26, the downstream side $O_2$ sensor 27, the catalytic converter 13 and the engine 1 and the prevention of the deterioration of emissions due to overcorrection may both be achieved.

The present invention has been described in connection with what are presently considered to be the most practical and preferred embodiments. However, the invention is not meant to be limited to the disclosed embodiments, but rather is intended to include all modifications and alternative arrangements included within the spirit and scope of the appended claims.

What is claimed is:

1. An air-fuel ratio controller for an engine, said controller comprising:

an upstream side air-fuel ratio detector, on an upstream side of a catalytic converter in an exhaust pipe of said engine, detecting an air-fuel ratio of exhaust gas discharged from said engine;

a downstream side air-fuel ratio detector, on a downstream side of said catalytic converter, detecting an air-fuel ratio of exhaust gas which has passed through said catalytic converter;

inversion direction determining means for determining an inversion direction of said air-fuel ratio detected by said downstream side air-fuel ratio detector when said air-fuel ratio detected by said downstream side air-fuel ratio detector passes from one of a rich side and a lean side through a stoichiometric air-fuel ratio to the other of said rich side and said lean side;

target air-fuel ratio setting means for correcting a target air-fuel ratio in a skip fashion by a predetermined skip amount in a direction opposite said inversion direction determined by said inversion direction determining means;

injection amount calculating means for calculating an injection amount of a fuel-injection valve at a predetermined updating rate based on a difference between said air-fuel ratio detected by said upstream side air-fuel ratio detector and said target air-fuel ratio set by said target air-fuel ratio setting means;

learning means for learning variations in operating parameters of at least one of said upstream side air-fuel ratio detector, said downstream side air-fuel ratio detector, said catalytic converter and said engine; and target air-fuel ratio guard setting means for setting upper and lower limit guards for said target air-fuel ratio corrected by said target air-fuel ratio setting means after learning by said learning means.

2. A controller according to claim 1, said target air-fuel ratio setting means further being for setting said target air-fuel ratio at said learned value if said target air-fuel ratio has not returned to said upper and lower limit guards within a predetermined time after reaching one of said upper limit guard and said lower limit guard.

3. A controller according to claim 1, wherein said learning means inhibits said learning when a number of step corrections by said target air fuel ratio setting means within said predetermined time is less than a predetermined number.

4. A controller according to claim 1, further comprising catalyst deterioration detecting means for detecting a deterioration state of a catalyst in said catalytic convert and for selectively increasing and decreasing a width between said upper and lower limit guards based on said deterioration state.

5. A controller according to claim 4, said target air-fuel ratio setting means further being for setting said target air-fuel ratio at said learned value if said target air-fuel ratio has not returned to said upper and lower limit guards within a predetermined time after reaching one of said upper limit guard and said lower limit guard.

6. A controller according to claim 5, wherein said target air-fuel ratio setting means is further for setting said predetermined time to a larger value responsive to an increase in said deterioration state.

7. A controller according to claim 1, further comprising re-learning setting means for re-learning variations in said operating parameters when said air-fuel ratio detected by said downstream side air-fuel ratio detector has not returned to a predetermined value within a predetermined time after learning by said learning means.

8. A controller according to claim 1, further comprising integration correction means for increasing said target air-fuel ratio by an integration amount when said air-fuel ratio detected by said downstream side air-fuel ratio detector is continuously rich and when said air-fuel ratio detected by said downstream side air-fuel ratio detector is continuously lean.

9. An air-fuel ratio controller for an engine, said controller comprising:

an upstream side air-fuel ratio detector, on an upstream side of a catalytic converter in an exhaust pipe of said engine, detecting an air-fuel ratio of exhaust gas discharged from said engine;

a downstream side air-fuel ratio detector, on a downstream side of said catalytic converter, detecting an air-fuel ratio of exhaust gas which has passed through said catalytic converter;

inversion direction determining means for determining an inversion direction of said air-fuel ratio detected by said downstream side air-fuel ratio detector when it passes from one of a rich side and a lean side through a stoichiometric air-fuel ratio to the other of said rich side and said lean side;

target air-fuel ratio setting means for correcting a target air-fuel ratio in a skip fashion by a predetermined skip amount in a direction opposite said inversion direction determined by said inversion direction determining means;

injection amount calculating means for calculating an injection amount of a fuel injection valve at a predetermined updating rate based on a difference between said air-fuel ratio detected by said upstream side air-fuel ratio detector and said target air-fuel ratio set by said target air-fuel ratio setting means;

learning means for learning variations in operating parameters of at least one of said upstream side air-fuel ratio detector, said downstream side air-fuel ratio detector, said catalytic converter and said engine; and target air-fuel ratio guard setting means for setting upper and lower limit guards for said target air-fuel ratio corrected by said target air-fuel ratio setting means and for narrowing a width between said upper and lower limit guards after learning by said learning means.

10. A controller according to claim 9, wherein said target air-fuel ratio guard setting means sets a width between said upper and lower limit guards to between 5 and 10% of said target air-fuel ratio.

11. A controller according to claim 9, wherein said target air-fuel ratio guard setting means narrows said width between said upper and lower limit guards between 0.2% and 1.0% of said target air-fuel ratio.

* * * * *